US007003233B2

(12) United States Patent
Matsuda et al.

(10) Patent No.: US 7,003,233 B2
(45) Date of Patent: Feb. 21, 2006

(54) IMAGE FORMING APPARATUS WITH A TONER REPLENISHING CONTROL FEATURE BASED ON STORED TONER DENSITY AND FLUIDITY INFORMATION, RELATED METHOD, AND DEVELOPING AGENT REPLENISHING CONTAINER FOR SAME

(75) Inventors: Kenji Matsuda, Shizuoka (JP); Hisayoshi Kojima, Shizuoka (JP); Akiyoshi Fujita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 10/648,605

(22) Filed: Aug. 27, 2003

(65) Prior Publication Data

US 2004/0091275 A1 May 13, 2004

(30) Foreign Application Priority Data

Aug. 30, 2002 (JP) ..... 2002-254982
Aug. 21, 2003 (JP) ..... 2003-297503

(51) Int. Cl.
*G03G 15/08* (2006.01)

(52) U.S. Cl. ..... 399/27; 399/44

(58) Field of Classification Search ..... 399/27, 399/24, 43, 44

See application file for complete search history.

(56) References Cited

U.S. PATENT DOCUMENTS

| | | | | |
|---|---|---|---|---|
| 4,758,861 | A * | 7/1988 | Nakamaru et al. | 399/59 |
| 5,142,332 | A | 8/1992 | Osawa et al. | 355/208 |
| 6,418,292 | B1 | 7/2002 | Isobe et al. | 399/258 |
| 6,704,521 | B1 * | 3/2004 | Isobe et al. | 399/12 |
| 2002/0025173 | A1 | 2/2002 | Isobe et al. | 399/12 |
| 2002/0150410 | A1 | 10/2002 | Matsuda et al. | 399/263 |
| 2002/0197085 | A1 | 12/2002 | Sugita et al. | 399/258 |

FOREIGN PATENT DOCUMENTS

| | | | |
|---|---|---|---|
| JP | 3-10272 | | 1/1991 |
| JP | 07248677 | A * | 9/1995 |
| JP | 2002268295 | A * | 9/2002 |
| JP | 2003076131 | A * | 3/2003 |

* cited by examiner

*Primary Examiner*—Quana Grainger
(74) *Attorney, Agent, or Firm*—Fitzpatrick, Cella, Harper & Scinto

(57) ABSTRACT

There is provided an image forming apparatus including the first developing agent storing section which stores toner, a toner replenishing member for supplying the toner in the first developing agent storing section to the second developing agent storing section, and a controller which controls operation of the toner replenishing member on the basis of information about the amount of toner used in the first developing agent storing section and information about the fluidity of the toner. By more accurately controlling a toner discharge amount of a toner replenishing container and detecting the remaining toner, the toner density in a developing unit can always be kept constant to meet the demand for higher-quality images. There can be provided an inexpensive compact image forming apparatus in which the replacement timing of a developing agent replenishing container is delayed to obtain a longer service life.

36 Claims, 25 Drawing Sheets

FIG. 5

ROTATIONAL SPEED CORRECTION TABLE

| FLAG COUNT | Na | Nb | Nc | Nd | Ne |
|---|---|---|---|---|---|
| ROTATIONAL SPEED CORRECTION TABLE B | B1 | B2 | B3 | B4 | B5 |

FIG. 7

UNIT DISCHARGE AMOUNT TABLE

| | M1 | M2 | M3 | M4 |
|---|---|---|---|---|
| P1 | A1-1 | A2-1 | A3-1 | A4-1 |
| P2 | A1-2 | A2-2 | A3-2 | A4-2 |
| P3 | A1-3 | A2-3 | A3-3 | A4-3 |

IMAGE FORMING APPARATUS WITH A TONER REPLENISHING CONTROL FEATURE BASED ON STORED TONER DENSITY AND FLUIDITY INFORMATION, RELATED METHOD, AND DEVELOPING AGENT REPLENISHING CONTAINER FOR SAME

FIELD OF THE INVENTION

The present invention relates to an electrophotographic image forming apparatus and, more particularly, to the arrangement of an image forming apparatus for highly precisely detecting the amount of toner discharged from a toner replenishing container and the amount of remaining toner, a control method of the image forming apparatus, a developing agent replenishing container of the image forming apparatus and a memory unit thereof, a control program, and a storage medium which stores the control program.

BACKGROUND OF THE INVENTION

A conventional electrophotographic image forming apparatus employs a process cartridge scheme in which a cartridge integrally includes a photosensitive body, charging means, developing means, cleaning means, and toner storage section and is detachably mounted in the image forming apparatus main body.

This cartridge scheme makes a further improvement in operability, and allows a user to facilitate the maintenance of the process means. This cartridge scheme is very popular in image forming apparatus main bodies.

The process means are classified into long- and short-life process means and housed in cartridges of long- and short-life process means. In this manner, the cartridges are prepared depending on the service lives of the main process means.

Examples are a developing cartridge in which the toner storage section and developing means are integrated, a drum cartridge in which an electrophotographic photosensitive body, charging means, and cleaning means are integrated, and the like.

Demand has recently arisen for a color electrophotographic image forming apparatus capable of forming color images. An introduction of a color image forming apparatus, which satisfies the following seven items, is expected:

(a) low running cost
(b) small space
(c) low energy
(d) high image quality
(e) high speed
(f) improvement of usability
(g) ecology A conventional process cartridge or developing cartridge must be replaced with a new one when toner stored in the cartridge runs out. Most of the cartridges are recycled and reused by recycle systems of cartridge manufacturers or general recycling companies, but are finally processed as the waste.

Cartridges preferably have longer service lives to reduce the total amount of waste from the viewpoints of environmental protection and energy savings. The process means (e.g., an electrophotographic photosensitive drum and developing roller) and toner must have longer service lives.

Assume that the service life of the process means becomes long and that toner corresponding to this service life is stored. The total toner weight is proportional to the service life. For example, when the service life of the process means lasts 50,000 images, the necessary toner weight is 1.25 kg to 1.5 kg. The large amount of toner is integrally stored in a cartridge, the total weight and volume of the cartridge become large, and operability may degrade.

The image forming apparatus main body requires a frame structure for supporting such a heavy cartridge with high precision, resulting in high cost of the whole apparatus.

A conventional toner replenishing 2-component developing system has a hopper portion which stores toner in the image forming apparatus main body. Toner is fed in an order of a toner replenishing container, hopper portion, and developing unit. Even if the toner replenishing container becomes empty, toner in the hopper can be used, thus providing a certain margin for a replacement timing of the toner replenishing container.

The presence of the hopper portion mechanism increases the number of components and the size of the cartridge, thus degrading the operability and increasing the cost as described above. The certain margin for the toner replacement timing of the toner replenishing container makes it impossible to accurately detect the toner replacement timing and the amount of toner left in the toner replenishing container. Trouble may occur in the image forming process near the end of the service life when the toner almost runs out. This may typically appear in the formation of a color image.

As described above, unless the remaining toner in the toner replenishing container can be accurately grasped, a clear color image cannot be formed although unused toner is still left in the toner replenishing container. For this reason, the cartridge replacement timing may be set earlier, and accordingly the resources cannot be efficiently used for the longer service life described above.

Demand has further arisen for higher image quality in a color image forming apparatus. A toner replenishing amount must be more accurately controlled to make constant a ratio (toner density) of the toner of the developing unit and the carrier in the toner replenishing 2-component developing system.

SUMMARY OF THE INVENTION

In order to solve the conventional problems described above, the present invention has as its object to precisely replenish a developing unit with toner from a toner replenishing container to stabilize the toner density in the developing unit, thereby achieving high-quality image formation.

Furthermore, there is provided a low-cost, compact image forming apparatus, a control method thereof, and a developing agent replenishing container and a memory unit thereof in which the toner density in a developing unit is always kept constant by highly precisely controlling the toner discharge amount of a toner replenishing container and detecting the amount of remaining toner, thereby meeting demand for higher-quality images and delaying the replacement timing of the developing agent replenishing container to achieve a long service life.

More specifically, it is an object of the present invention to provide a low-cost, compact image forming apparatus, a control method thereof, and a developing agent replenishing container and a memory unit thereof in which the toner density in a developing unit is always kept constant by highly precisely controlling the toner discharge amount of a toner replenishing container to acquire higher-quality images and the replacement timing of the developing agent replenishing container is delayed by detecting the amount of remaining toner with high precision, thereby achieving a long service life.

The present invention which intends to solve the conventional problems and achieve the above object can also be implemented in a control method of controlling the above image forming apparatus, a control program, and a storage medium which stores the control program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a table showing a rotational speed correction table according to the embodiment of the present invention;

FIG. 7 shows a unit discharge amount table according to the embodiment of the present invention;

DETAILED DESCRIPTION OF THE PREFERRED EMBODIMENT

A preferred embodiment of the present invention will now be described in detail in accordance with the accompanying drawings.

In an image forming apparatus according to the present invention, toner replenishing containers accommodating toner and cartridges (process cartridges or developing cartridges) connectable to the replenishing containers can independently be mounted onto the main body of the image forming apparatus.

More specifically, the image forming apparatus is configured as a toner replenishing 2-component development system which prolongs the service life of each cartridge arrangement as an expendable and replenishes the cartridge with toner from the corresponding toner replenishing container as needed.

Since a toner replenishing 2-component development system according to this embodiment has no conventional hopper portion in an image forming main body, it is necessary to accurately detect the replacement timings of toner replenishing containers.

In this embodiment, an electrophotographic color image forming apparatus will be exemplified. Note that a longitudinal direction will refer to a direction perpendicular to the convey direction of a printing medium 2 hereinafter, which is the same as the axial direction of electrophotographic photosensitive bodies (to be referred to as photosensitive drums 7 hereinafter). The right and left directions are those with respect to the convey direction of the printing medium 2. Additionally, the upper and lower directions are those in the mounting state of the cartridge.

(System Arrangement)

Figure 19:
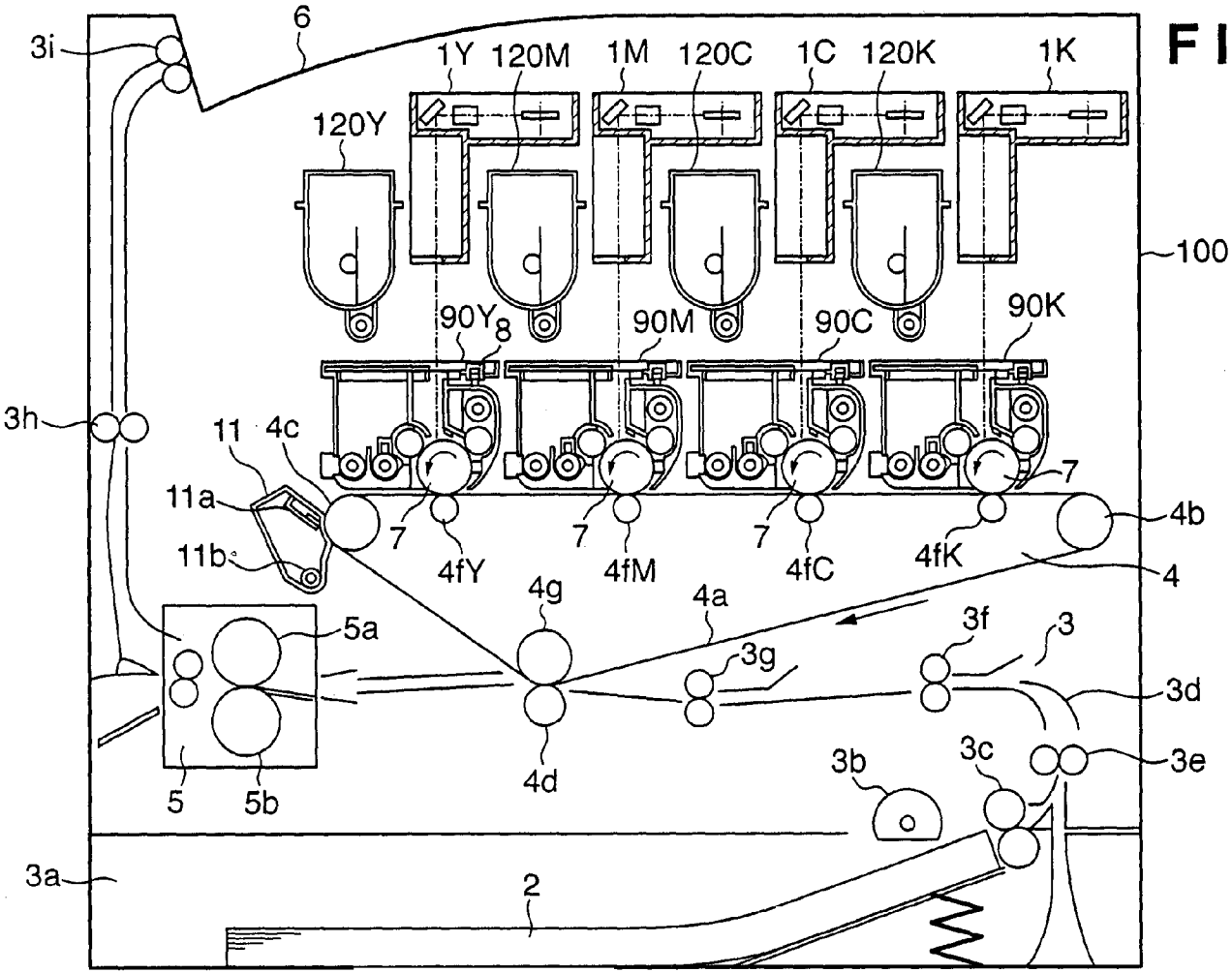
FIG. 19 is a sectional view showing the arrangement of a color laser printer according to the embodiment of the present invention.

The schematic system arrangement of an electrophotographic color image forming apparatus will be described with reference to FIGS. 19 to 25. FIG. 19 shows the overall arrangement of a color laser beam printer as the color image forming apparatus.

In the image forming section of the color laser beam printer, four process cartridges 90Y, 90M, 90C, and 90K (yellow, magenta, cyan, and black) comprising the respective photosensitive drums 7 serving as image carriers are arranged, and exposing sections 1Y, 1M, 1C, and 1K (each comprising a laser beam optical scanning system) for the respective colors are arranged above the process cartridges 90Y, 90M, 90C, and 90K.

A feed section 3 which feeds the printing medium 2, an intermediate transfer belt 4*a* which transfers a toner image formed on the photosensitive drum 7, and a secondary transfer roller 4*d* which transfers the toner image on the intermediate transfer belt 4*a* onto the printing medium 2 are arranged below the image forming section. In addition, a fixing section 5 which fixes the transferred toner image on the printing medium 2 and a delivery section which delivers the printing medium 2 and stacks it outside the image forming apparatus are arranged in the image forming section. Examples of the printing medium 2 include, e.g., a paper sheet, OHP sheet, cloth, and the like.

The image forming apparatus of this embodiment adopts a cleanerless system. Toner left on the photosensitive drum 7 upon transfer is received into a developing section. Each process cartridge incorporates no cleaner designed specifically to recover and store toner left upon transfer.

An electrophotographic image forming apparatus refers to an apparatus which forms an image on a printing medium using an electrophotographic image forming process. Such apparatuses include, e.g., an electrophotographic copying machine, electrophotographic printer (LED printer, laser beam printer, or the like), electrophotographic facsimile apparatus, electrophotographic word processor, and the like.

A process cartridge is formed by integrating at least one of a charging section, developing section, and cleaning section and the photosensitive drum 7 as an image carrier into a cartridge. The process cartridge is arranged to be detachable from the image forming main body. A developing cartridge is formed by integrating a toner storage section and a developing section into a cartridge and is arranged to be detachable from the image forming main body.

The arrangements of the respective sections of the color image forming apparatus will sequentially be described in detail next.

(Feed Section)

The feed section 3 feeds the printing medium 2 to the image forming section. The feed section 3 mainly comprises a feed cassette 3*a* which holds a plurality of stacked recoding media 2, a feed roller 3*b*, a retard roller 3*c* to avoid double feed, a feed guide 3*d*, and a registration roller 3*g*.

The feed roller 3*b* is rotatably driven in accordance with image forming operation and separately feeds the printing media 2 in the feed cassette 3*a* one by one. The printing medium 2 is guided by the feed guide 3*d* and conveyed to the registration roller 3*g* through convey rollers 3*e* and 3*f*.

The registration roller 3*g* is not rotating immediately after the printing medium 2 is conveyed to the registration roller 3*g*. For this reason, the transferred printing medium 2 runs into this nip portion, thereby removing any skew of the printing medium 2.

During image forming operation, the registration roller 3*g* performs irrotational operation of making the printing medium 2 stand by in a stationary state and rotational operation of conveying the printing medium 2 toward the intermediate transfer belt 4*a* in accordance with a predetermined sequence. The registration roller 3*g* registers the printing medium 2 with a toner image in the transfer step as the next step.

(Process Cartridge)

Each of the process cartridges 90Y, 90M, 90C, and 90K has a charging section and developing section around the photosensitive drum 7 serving as an image carrier to constitute an integral arrangement. The user can easily detach the process cartridge from the apparatus main body. The photosensitive drum 7 is replaced with a new one if its service life ends or it arrives at its replacement timing.

In this embodiment, for example, the number of rotations of the photosensitive drum 7 is counted. If the number exceeds a predetermined count, the end of the service life or the arrival of the replacement timing of the corresponding process cartridge is notified.

The photosensitive drum 7 of this embodiment is a negatively-charged organic photosensitive body. The photosensitive drum 7 has a photosensitive body layer on a drum base of aluminum having a diameter of about 30 mm and a charge injection layer as the uppermost layer. The photosensitive drum 7 is rotatably driven at a predetermined speed, about 117 mm/sec in this embodiment. The charge injection layer uses, e.g., a coating layer made of a material in which superfine $SnO_2$ particles are dispersed as fine conductive particles for a binder of insulating resin.

Figure 20:
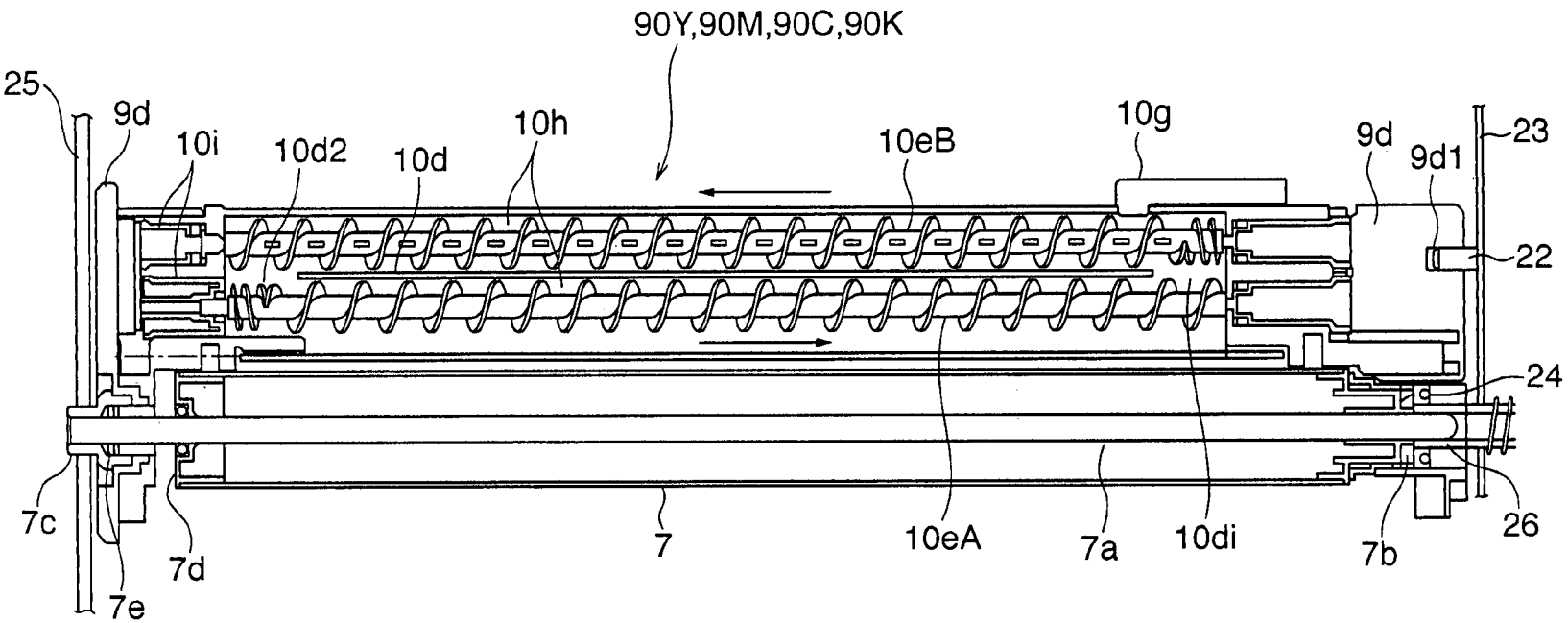
FIG. 20 is a sectional view showing the arrangement of a process cartridge according to the embodiment of the present invention.

As shown in FIG. 20, a drum flange 7*b* is fixed at the rear end of the photosensitive drum 7, and a nondriven flange 7*d* is fixed at the front end. A drum shaft 7*a* extends through the centers of the drum flange 7*b* and nondriven flange 7*d*, and the drum flange 7*b* and nondriven flange 7*d* are rotated integrally with the drum shaft 7*a*. More specifically, the photosensitive drum 7 rotates about the drum shaft 7*a*.

The front end of the drum shaft 7*a* is rotatably supported by a bearing 7*e*, which is fixed with respect to a bearing case 7*c*. The bearing case 7*c* is fixed to the frame of the process cartridge.

(Charging Section)

Figure 21:
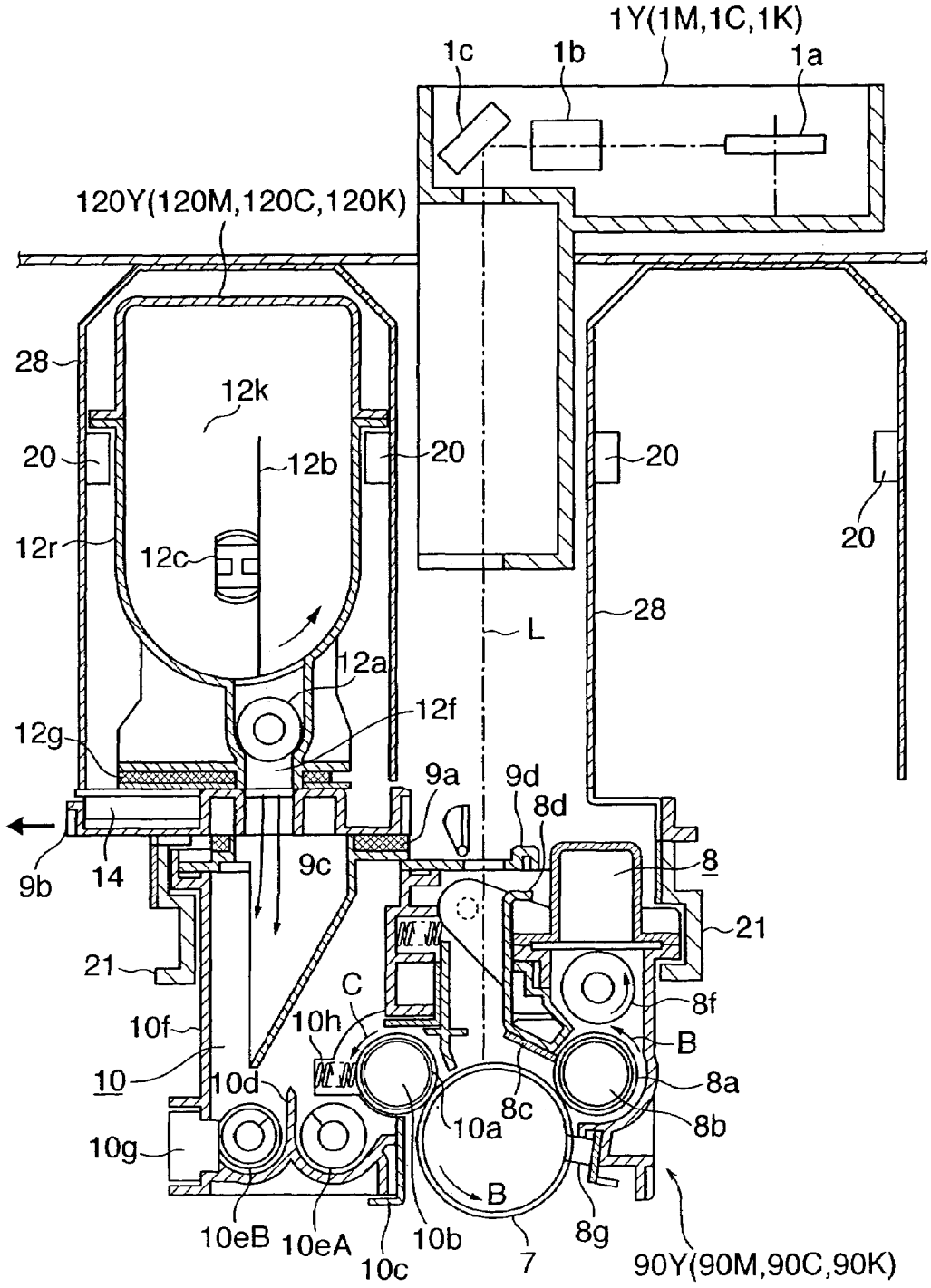
FIG. 21 is a sectional view showing the assembly state of the toner replenishing container and process cartridge according to the embodiment of the present invention.

In FIG. 21, each charging section comprises a magnetic brush charging apparatus 8 which uses magnetic particles as a charging member. In this embodiment, a contact charging method is adopted.

More specifically, the charging section has a magnetic brush portion formed by magnetically attracting conductive magnetic particles. The magnetic brush portion is made to come into contact with the photosensitive drum 7, and a voltage is applied to the photosensitive drum 7, thereby charging the surface of the photosensitive body.

Such a charging method (charging, of an object to be charged, by direct injection of charges) is referred to as "injection charging". The use of this injection charging method eliminates the need for a cleaning mechanism (cleaning blade, cleaning roller, or the like) which mechanically scrapes off toner remaining on the photosensitive drum 7. Such a cleanerless system will be described later.

An injection charging method according to this embodiment utilizes no electric discharge phenomenon in which an object to be charged is charged using a corona charger. For this reason, only a charging bias corresponding to a desired surface potential of the object to be charged needs to be applied at the time of charging, and no ozone generates.

More specifically, the method performs completely ozoneless, low-power consumption charging.

(Magnetic Brush Charging Apparatus)

The arrangement of the magnetic brush charging apparatus 8 will be described in detail. In FIG. 21, the magnetic brush charging apparatus 8 has a magnetic brush layer of magnetic particles formed on a charging sleeve 8*a* incorporating a magnet roller 8*b*. The magnetic brush charging apparatus 8 charges the photosensitive drum 7 to a desired potential at the abutting portion between the photosensitive drum 7 and the brush.

The almost left half of the outer surface of the charging sleeve 8*a* projects into the opening portion of a charging container storing magnetic particles along the longitudinal direction, and the almost right half of the outer surface is arranged to be exposed outside. The surface of the charging sleeve 8*a* is appropriately coarsened to form projections and recesses so as to satisfactorily convey magnetic particles.

The magnet roller 8*b* inside the charging sleeve 8*a* is subjected to 4-pole magnetization in its circumferential direction. To prevent magnetic particles attracted to the photosensitive drum 7 from separating from the photosensitive drum 7 due to rotation of the photosensitive drum 7, the magnet roller 8*b* is fixed such that a pole, and more specifically, a pole S1 faces in the direction of the center of the photosensitive drum 7.

A nonmagnetic plate-like regulating blade 8*c* is spaced apart from the surface of the charging sleeve 8*a* by a predetermined distance. Magnetic particles are held by the magnet roller 8*b* and conveyed in the direction of an arrow by rotation of the charging sleeve 8*a*. The magnetic particles are leveled by the regulating blade 8*c* to a predetermined thickness, thereby forming a magnetic brush portion on the charging sleeve 8*a*.

The charging sleeve 8*a* is arranged to face the photosensitive drum 7 so as to keep a predetermined distance from the photosensitive drum 7. The magnetic brush comes into contact with the surface of the photosensitive drum 7, thereby forming a charging nip portion. The width of the charging nip portion affects the chargeability of the photosensitive drum 7. In this embodiment, the distance is adjusted such that the nip portion has a width of about 6 mm.

The charging sleeve 8*a* is rotatably driven by a motor (not shown) in a direction opposite to the photosensitive drum 7 serving as an object to be charged, i.e., the direction of an arrow B in FIG. 21. In this embodiment, the photosensitive drum 7 rotates at a speed V1, while the charging sleeve 8*a* rotates in the counter direction at a speed $V2 \approx 1.5 \times V1$.

As the rotational speed of the magnetic brush portion relative to the photosensitive drum 7 increases, the possibility of contact between them increases. For this reason, the charging uniformity improves, and the attraction properties of toner left upon transfer with respect to the magnetic brush improves. A predetermined charging bias is applied from a charging bias power supply (not shown) through the charging sleeve 8*a* to the magnetic brush portion. The surface of the photosensitive drum 7 is charged to have predetermined polarity and potential at the charging nip portion.

As conductive magnetic particles constituting the magnetic brush portion, magnetic metal particles of, e.g., ferrite, magnetite, and the like and a product formed by bonding with resin these conductive magnetic particles may also be used. A stirring member 8*f* is substantially parallel to the charging sleeve 8*a* and is rotatably supported between the walls of the two ends, in the longitudinal direction, of the charging container.

A charging brush 8*g* is made to come into contact with the surface of the photosensitive drum such that its distal end is bent by about 1 mm, and a predetermined voltage is applied to the charging brush 8*g*. The contact by the charging brush 8*g* uniformly disperses toner remaining on the surface of the photosensitive drum 7. Additionally, static elimination uniformly performs charging in the next step.

(Cleanerless System)

A cleanerless system in a reverse development system will be described next. In the reverse development system, the photosensitive drum 7 is negatively charged, and the negatively charged toner undergoes development at a low-potential portion of the exposed section.

In FIG. 21, out of a small amount of toner left on the photosensitive drum 7 upon transfer, positively charged toner is first electrostatically received into the magnetic brush charging apparatus 8. The remainder is forcibly scraped off and recovered into the magnetic brush charging apparatus 8. The toner is negatively charged due to friction between the toner and magnetic particles in the magnetic brush charging apparatus 8 and then discharged onto the photosensitive drum 7.

On the other hand, negatively charged toner out of the toner left upon transfer is hardly received into the magnetic brush charging apparatus 8 and is recovered into a developing unit 10 together with the toner discharged from the magnetic brush charging apparatus 8 (concurrent execution of development and cleaning).

Reception of toner into the developing unit 10 in this concurrent development and cleaning is performed by an antifog bias at the time of development. An antifog bias refers to an antifog potential difference, i.e., a potential difference between a direct voltage to be applied to the developing unit and the surface potential of the photosensitive drum 7.

With this method, part of toner left upon transfer is recovered through the magnetic brush charging apparatus, and the remainder is directly recovered, into the development apparatus. The recovered toner is utilized in the next step. This can eliminate the need to discard toner and save trouble in maintenance. In addition, the absence of cleaners brings about great benefits in terms of space and can greatly reduce the size of an image forming apparatus.

(Exposing Section)

In this embodiment, the photosensitive drum 7 is exposed by means of a laser exposing means. More specifically, when an image signal is sent from the apparatus main body, the uniformly charged surface of the photosensitive drum 7 is scanned and exposed with laser beams L modulated in accordance with the signal. An electrostatic latent image corresponding to image information is selectively formed on the surface of the photosensitive drum 7.

As shown in FIG. 21, the laser exposing means comprises a solid-state laser element (not shown), a polygon mirror 1*a*, an imaging lens 1*b*, a reflection mirror 1*c*, and the like. The solid-stage laser element is controlled by a light-emitting signal generator (not shown) to flash on and off at predetermined timings on the basis of an input image signal.

The laser light beam L emitted from the solid-state element is converted into a substantially parallel beam by a collimator lens system (not shown) and scanned by the polygon mirror 1*a* which rotates at a high speed. The beam passes through the imaging lens 1*b* and reflection mirror 1*c*, and a spot-like image is formed on the photosensitive drum 7.

As described above, for the photosensitive drum 7, exposure in the main scanning direction is performed by laser light beam scanning, and exposure in the subscanning direction is performed by rotation of the photosensitive drum 7. Consequently, an exposure distribution corresponding to the image signal is obtained.

Moreover, a bright potential with a low surface potential is formed by irradiation with the laser light beam L, and a dark potential without any potential drop is formed by non-irradiation with the laser light beam L. With the contrast between the bright potential and the dark potential, an electrostatic latent image corresponding to image information is formed.

(Developing Section)

The arrangement of the developing section will be described with reference to FIG. 21. The developing unit 10 serving as the developing section comprises a 2-component contact developing unit (2-component magnetic brush developing unit) and stores a developing agent containing a carrier and toner on a developing sleeve 10*a* serving as a developing agent carrier incorporating a magnet roller 10*b*.

A regulating blade 10*c* is spaced apart from the developing sleeve 10*a* by a predetermined distance. The regulating blade 10*c* forms a thin layer of the developing agent on the developing sleeve 10*a* as the developing sleeve 10*a* rotates in the direction of an arrow C. The developing sleeve 10*a* is spaced apart from the photosensitive drum 7 by a predetermined distance. The distance is set at the time of development such that the developing agent on the developing sleeve 10*a* comes into contact with the photosensitive drum 7. The developing sleeve 10*a* is rotatably driven at a predetermined circumferential speed in a clockwise direction indicated by an arrow, i.e., a direction opposite to the rotational direction of the photosensitive drum 7.

Toner used in this embodiment comprises negatively charged toner having an average particle size of 6 $\mu$m. As a magnetic carrier, one with a saturation magnetization of 205 emu/cm$^3$ and an average particle size of 35 $\mu$m is employed. A mixture prepared by mixing the toner and the carrier at a weight ratio of 8:92 is employed as the developing agent. A developing agent storage section 10*h* in which the developing agent circulates is divided into two by a partition 10*d* in the longitudinal direction, except for its two ends. Stirring screws 10*e*A and 10*e*B are so arranged as to sandwich the partition 10*d*.

Toner supplied from each toner replenishing container falls on the front side of the stirring screw 10*e*B as a toner replenishing unit, is stirred while being conveyed to the rear side in the longitudinal direction, and passes through a portion at the rear end, to which the partition 10*d* does not extend. The toner is further conveyed to the front side in the longitudinal direction by the stirring screws 12*a* and 10*e*B and passes through a portion at the front end, to which the partition 10*d* does not extend to. The toner is then stirred while being conveyed by the stirring screws 12*a* and 10*e*B. In this manner, toner circulates.

The developing step of visualizing an electrostatic latent image formed on the photosensitive drum 7 by a 2-component magnetic brush method using the developing unit and the circulating system of a developing agent will be described. As the developing sleeve 10*a* rotates, a developing agent in a developing container is pumped up onto the surface of the developing sleeve 10*a* by an N3 pole of the magnet roller 10*b* and conveyed. In the conveying process, the regulating blade 10*c*, which is so arranged as to be perpendicular to the developing sleeve 10*a*, regulates the thickness of the developing agent, thereby forming a thin developing agent layer on the developing sleeve 10*a*.

When the thin developing agent layer is conveyed to a developing pole N1 corresponding to the developing section, a magnetic force causes the developing agent to have the shape of a spike. The electrostatic latent image on the surface of the photosensitive drum 7 is developed as a toner image by toner in the spike-shaped developing agent. In this embodiment, the electrostatic latent image is subjected to reverse development.

The thin developing agent layer on the developing sleeve 10*a*, having passed the developing section, enters the developing container as the developing sleeve 10*a* rotates. The thin developing agent layer separates from the developing sleeve 10*a* by the repulsive fields of an N2 pole and the N3 pole and returns to a developing agent pocket in the developing container. DC and AC voltages are applied from a power supply (not shown) to the developing sleeve 10*a*. In this embodiment, a DC voltage of −500 V and an AC voltage having a peak-to-peak voltage of 1,500 V at a frequency of 200 Hz are applied to the developing sleeve 10*a*, and only the exposed portion of the photosensitive drum 7 is selectively developed.

Generally, in a 2-component developing method, application of an AC voltage increases the developing efficiency and improves the quality of images. However, this also contributes to occurrence of fogging. For this reason, a potential difference is made between a DC voltage to be applied to the developing sleeve 10*a* and the surface potential of the photosensitive drum 7, thereby avoiding fogging. More specifically, a bias voltage having a potential between the potential of the exposed portion of the photosensitive drum 7 and that of the nonexposed portion is applied.

This potential difference to avoid fogging is referred to as an antifog potential (Vback). The potential difference prevents toner from settling on the nonimage region (nonexposed portion) of the surface of the photosensitive drum 7 at the time of development. In addition, the potential difference recovers toner left on the surface of the photosensitive drum 7 upon transfer in an apparatus of a cleanerless system. More specifically, the system adopts a concurrent development and cleaning arrangement.

When toner is consumed in development, the toner density in the developing agent decreases. In this embodiment, an inductance sensor 10*g* is arranged in the vicinity of the outer surface of the stirring screw 10*e*B to detect the toner density. When the inductance sensor 10*g* detects that the toner density in the developing agent falls below a predetermined density level, an instruction to supply toner from the toner replenishing container to the developing unit is issued. With this toner replenishing operation, the toner density in the developing agent is always maintained at the predetermined level.

(Toner Replenishing Container)

The arrangement of the toner replenishing container will be described with reference to FIGS. 19, 20, 21, and 22. In FIG. 19, toner replenishing containers 120Y, 120M, 120C, and 120K are arranged in parallel above the process cartridges 90Y, 90M, 90C, and 90K. The toner replenishing containers 120Y, 120M, 120C, and 120K are mounted from the front of an apparatus main body 100.

Figure 22:
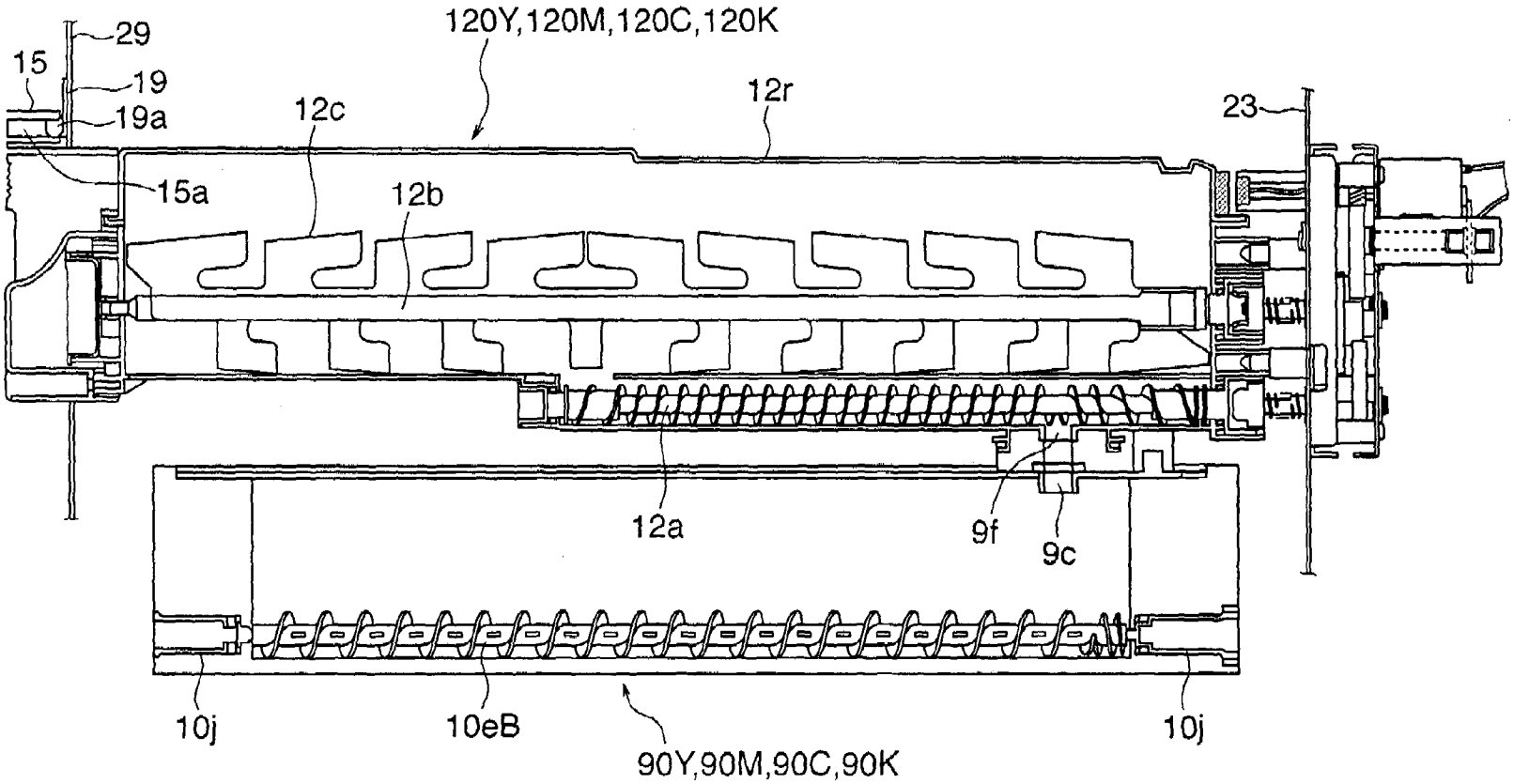
FIG. 22 is a sectional view of the toner replenishing container and process cartridge according to the embodiment of the present invention, as seen in the longitudinal direction.

Referring to FIGS. 21 and 22, a stirring plate 12*c* fixed on a stirring shaft 12*b* and a convey screw 12*a* as a toner replenishing unit are arranged in the toner replenishing container 120Y (120M, 120C, or 120K). A discharge opening portion 12*f* is formed on the bottom surface of the container to discharge toner.

Figure 23:
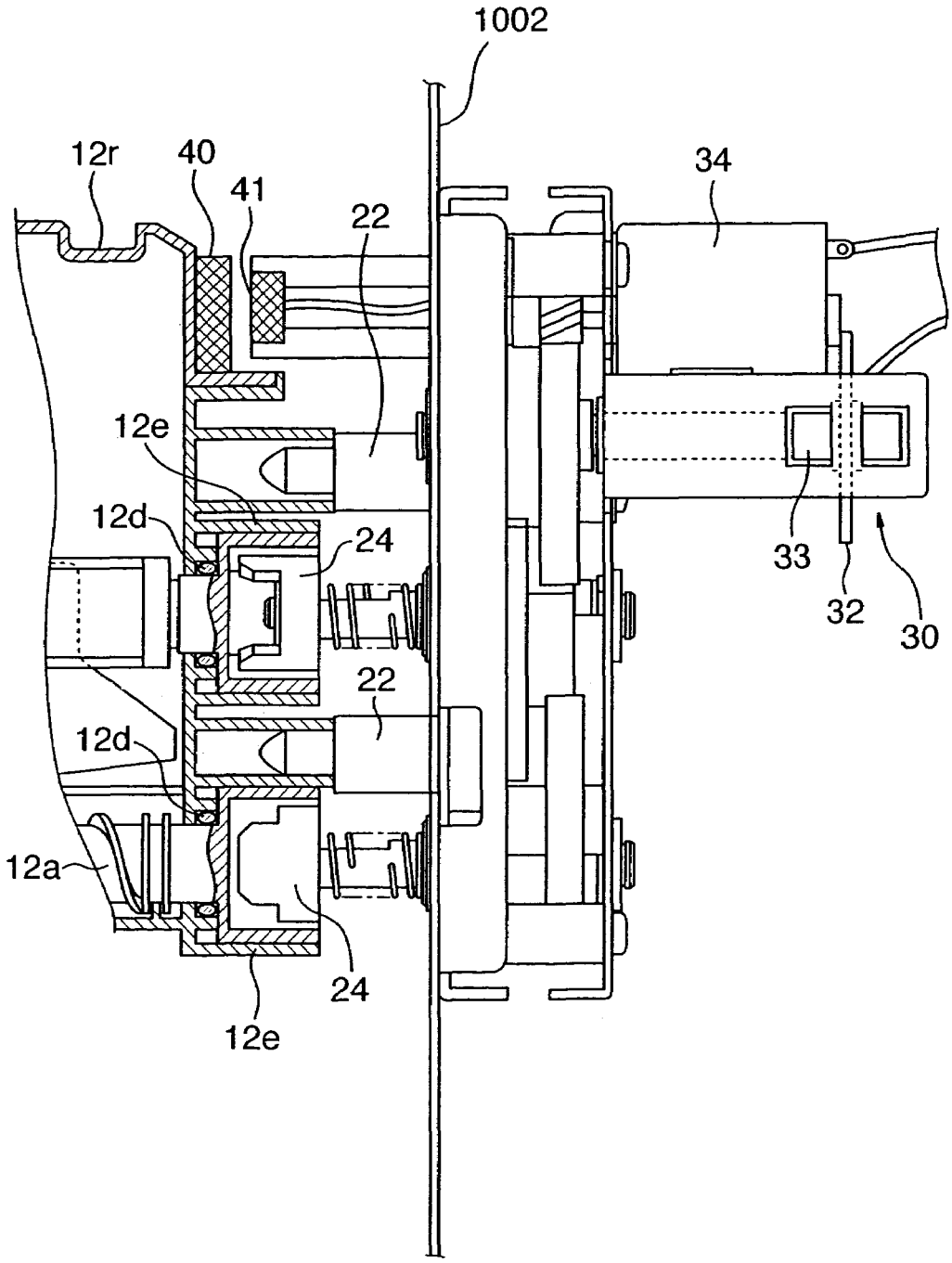
FIG. 23 is a sectional view showing the arrangement of the rear side, in the longitudinal direction, of the toner replenishing container according to the embodiment of the present invention.
Figure 24:
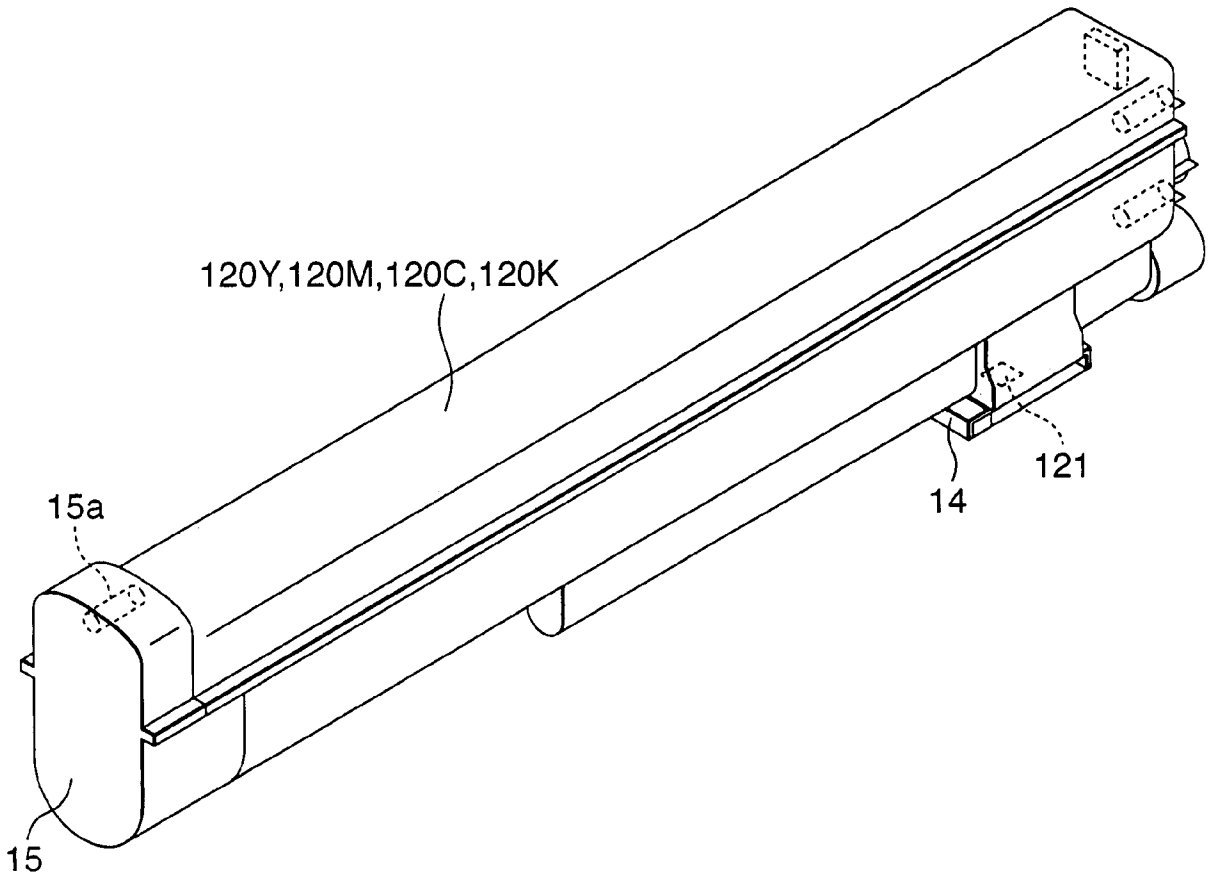
FIG. 24 is a perspective view showing the outer appearance of the toner replenishing container according to the embodiment of the present invention.
Figure 25:
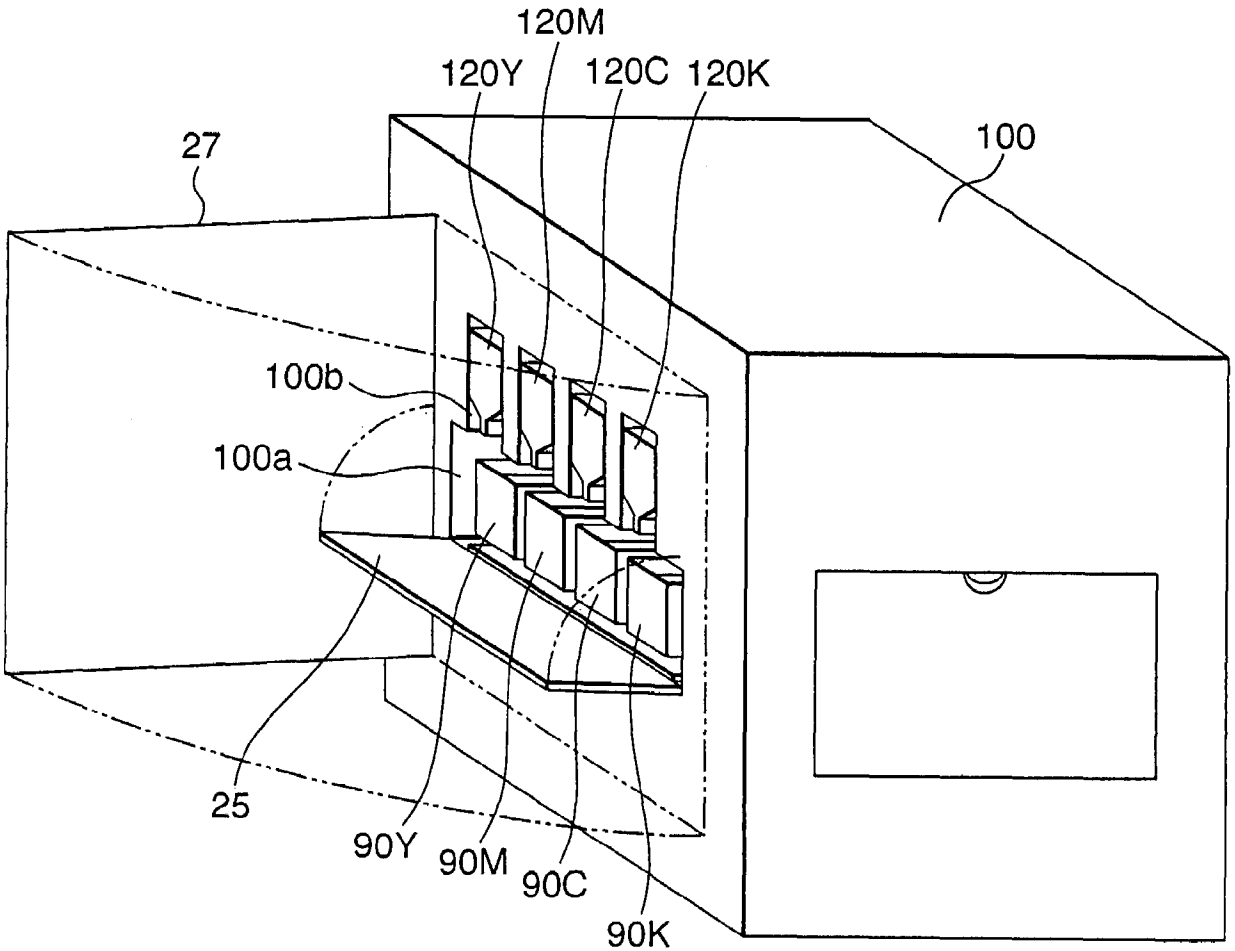
FIG. 25 is a perspective view showing the outer appearance of the color laser printer according to the embodiment of the present invention.

In FIG. 23, the two ends of each of the convey screw 12*a* and the stirring shaft 12*b* are rotatably supported by bearings 12*d*, and a drive coupling (concave) 12*e* is arranged at one outermost end of each of them. The drive coupling (concave) 12*e* receives a driving force transmitted from a driving coupling (convex) 24 of the apparatus main body and is rotatably driven.

The convey screw 12*a* outwardly has a helical, ribbed shape and reverses the helical direction about the discharge opening portion 12*f*.

Rotation of the driving coupling (convex) 24 causes the convey screw 12*a* to rotate in a predetermined rotational direction. Toner is conveyed toward the discharge opening g portion 12*f* and falls freely from the discharge opening portion 12*f*, thereby replenishing the corresponding process cartridge with toner.

The tip portion, in the direction of the turning radius, of the stirring plate is tilted. When the tip portion comes into slidable contact with the wall surface of the toner replenishing container, it abuts against the wall surface at a certain angle. More specifically, the tip portion of the stirring plate is twisted in a helical manner. This twist and tilt of the tip portion of the stirring plate generates a conveying force in the axial direction, and toner is conveyed in the longitudinal direction.

The toner replenishing container of this embodiment may be applied not only to a 2-component developing method, but also to a process cartridge or developing cartridge using a 1-component developing method. Additionally, powder to be stored in the toner replenishing container is not limited to toner. Needless to say, a so-called developing agent prepared by mixing toner and a magnetic carrier may be employed.

(Transfer Section)

The arrangement of a transfer section will be described next. In FIG. 19, an intermediate transfer unit 4 serving as the transfer section collectively secondarily transfers a plurality of toner images, sequentially overlaid from the photosensitive drum 7 in primary transfer, onto the printing medium 2.

The intermediate transfer unit 4 comprises the intermediate transfer belt 4*a* which runs in the direction of an arrow and runs in a clockwise direction indicated by an arrow at almost the same circumferential speed as the speed of the outer surface of the photosensitive drum 7. The intermediate transfer belt 4*a* is an endless belt having a perimeter of about 940 mm and is laid across three rollers, i.e., a driving roller, a secondary transfer opposing roller 4*g*, and a driven roller.

Transfer charging rollers 4*f*Y, 4*f*M, 4*f*C, and 4*f*K are rotatably arranged at positions opposing to the respective photosensitive drums 7 within the intermediate transfer belt 4*a*. Each transfer charging roller is pressed in the direction of the center of the corresponding photosensitive drum 7.

The transfer charging rollers 4*f*Y, 4*f*M, 4*f*C, and 4*f*K are fed from a high-voltage power supply (not shown) and perform charging of a polarity opposite to that of toner from the back side of the intermediate transfer belt 4*a*. Toner images on the respective photosensitive drums 7 are sequentially primarily transferred onto the upper surface of the intermediate transfer belt 4*a*.

Although the intermediate transfer belt 4*a* may be made of polyimide resin, it is not limited to polyimide resin. Other preferable materials include a plastic such as polycarbonate resin, polyethyleneterephthalate resin, PVDF resin, polyethylenenaphthalate resin, polyether ether ketone resin, polyethersulfone resin, or polyurethane resin, a fluororubber, and a silicone-based rubber.

In a secondary transfer section, the secondary transfer roller 4*d* serving as a transfer member comes into tight contact with the intermediate transfer belt 4*a* at a position opposing to the secondary transfer opposing roller 4*g*. The secondary transfer roller 4*d* is so fixed as to swing vertically with respect to the sheet surface of FIG. 19. If the intermediate transfer belt 4*a* is to be replaced with a new one or paper jam occurs at the secondary transfer section, the secondary transfer roller 4*d* can retreat to a predetermined position, thereby enabling operations such as replacement.

The intermediate transfer belt 4*a* and secondary transfer roller 4*d* are separately driven. When the printing medium 2 plunges into the secondary transfer section, a predetermined bias is applied to the secondary transfer roller 4*d*, and a toner image on the intermediate transfer belt 4*a* is secondarily transferred onto the printing medium 2. At this time, the printing medium 2 sandwiched by the intermediate transfer belt 4*a* and the secondary transfer roller 4*d* is conveyed in the left direction of the sheet surface of FIG. 19 at a predetermined speed simultaneously with the transfer step and then conveyed toward the fixing section 5 for the next step. A cleaning unit 11 which can come into contact with/separate from the surface of the intermediate transfer belt 4*a* is arranged at a predetermined position of the intermediate transfer belt 4*a*, which is on the most downstream side of the transfer step. The cleaning unit removes toner left on the surface of the intermediate transfer belt 4*a* upon transfer.

A cleaning blade 11*a* is arranged in the cleaning unit 11 to remove toner left upon transfer. The cleaning unit is so mounted as to swing about the rotation center (not shown), and the cleaning blade 11*a* comes into tight contact with the cleaning unit 11 so as to bite into the intermediate transfer belt 4*a*. The toner left upon transfer, which is received into the cleaning unit 11, is conveyed to a tank (not shown) for toner to be discarded by a feed screw 11*b* and stored in the tank.

(Fixing Section)

The arrangement of a fixing section will be described next. In FIG. 19, a toner image which is formed on the photosensitive drum 7 by the developing section is transferred onto the printing medium 2 through the intermediate transfer belt 4*a*. The fixing section 5 fixes the transferred toner image on the printing medium 2 using heat.

The fixing section 5 comprises a fixing roller 5*a* for applying heat to the printing medium 2 and a press roller 5*b* for bringing the printing medium 2 into tight contact with the fixing roller. Each of the fixing roller 5*a* and press roller 5*b* comprises a hollow roller and incorporates a heater (not shown). Both rollers are rotatably driven to simultaneously convey the printing medium 2.

More specifically, while the printing medium 2 bearing a toner image is conveyed by the fixing roller 5*a* and press roller 5*b*, heat and pressure are applied to the printing medium 2. With this operation, the toner image is fixed on the printing medium 2. The printing medium 2 having undergone fixing is delivered by delivery rollers 3*h* and 3*j* and stacked onto a tray 6 on the apparatus main body 100.

(Mounting of Process Cartridge and Toner Replenishing Container)

The procedures for mounting the process cartridges 90Y to 90K and the toner replenishing containers 120Y to 120K will be described with reference to FIGS. 21 to 25. In FIG.

25, a front door 27 which can freely open and close is arranged at the front of the apparatus main body 100. When the front door 27 is opened forward, an opening portion for inserting the process cartridges 90Y to 90K and the toner replenishing containers 120Y to 120K is exposed.

A rotatably supported centering plate 25 is arranged in a part for inserting the process cartridges 90Y to 90K, out of the opening portion. The process cartridges 90Y to 90K must be inserted/removed after the centering plate 25 is opened/closed. In FIG. 21, guide rails 21 which guide the process cartridges 90Y to 90K for mounting and guide rails 20 which guide the toner replenishing containers 120Y to 120K for mounting are fixed in the apparatus main body 100.

The process cartridges 90Y to 90K and the toner replenishing containers 120Y to 120K are mounted in a direction parallel to the axial direction of the photosensitive drum 7, and the guide rails 21 and 20 are arranged in the same direction. The process cartridges 90Y to 90K and the toner replenishing containers 120Y to 120K slide along the guide rails 21 and 20 and are inserted from the front side of the apparatus main body 100 to the rear side.

When the process cartridges 90Y to 90K are inserted to the rearmost portion, the rear end of the drum shaft 7*a* is inserted into a centering shaft 26 of the apparatus main body 100, and the position of the rotation center at the rear end of the photosensitive drum 7 is determined with respect to the apparatus main body 100. At the same time, the drum flange 7*b* is coupled to the driving coupling (convex) 24, thereby enabling the photosensitive drum 7 to be rotatably driven.

Support pins 22 which position the process cartridges 90Y to 90K are arranged on a rear side plate 23. The support pins 22 are inserted into the frames of the respective process cartridges 90Y to 90K to fix their frame positions.

The rotatable centering plate 25 is arranged on the front side of the apparatus main body 100. The bearing cases 7*c* of the respective process cartridges 90Y to 90K are supported and fixed with respect to the centering plate 25. With this inserting operation, the photosensitive drums 7 and process cartridges 90Y to 90K are positioned with respect to the apparatus main body 100.

Referring to FIGS. 22 and 23, when the replenishing containers 120Y to 120K are inserted to the rearmost portion, they are fixed with respect to the support pins 22 which project from the rear side plate 23. At the same time, the drive coupling (concave) 12*e* is coupled to the driving coupling (convex) 24, thereby enabling the convey screw 12*a* and stirring shaft 12*b* to be rotatably driven.

Positioning plates 19 are arranged on a front side plate 29, and holes 15*a* of holders 15 formed on the front side of the toner replenishing containers 120Y to 120K engage with shafts 19*a* of the positioning plates 19, respectively. With this engagement, the front-side positions of the toner replenishing containers 120Y to 120K are determined.

(Storage Medium)

A storage medium will be described next. A storage medium to be employed is not specifically limited, and any will do as far as it can rewritably store signal information. For example, an electrical storage medium such as RAM and erasable ROM, a magnetic storage medium or magnetic bubble memory, a magneto-optical memory, or the like may be used.

(Electrical Arrangement of System)

Figure 1:
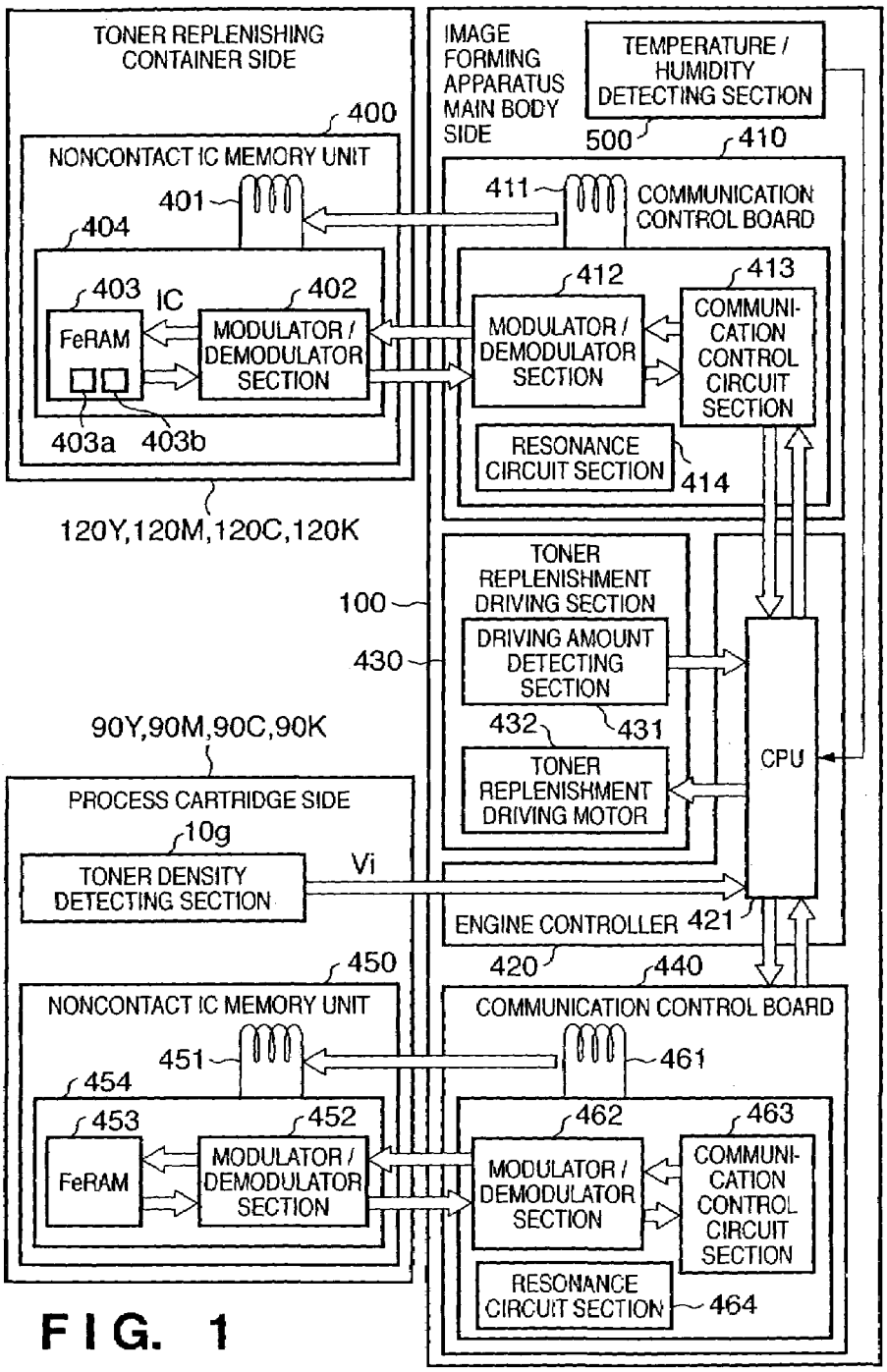
FIG. 1 is a block diagram schematically showing the electrical system arrangement of a non-contact IC memory unit in a toner replenishing container and a communication control section of a color laser printer, according to an embodiment of the present invention.

The electrical arrangement of a system according to the present invention will be described. FIG. 1 is a block diagram showing a non-contact IC memory unit 400 serving as a storage medium and a communication control section 410. In this system, a ferroelectric nonvolatile memory (FeRAM 403) is employed as a non-contact IC memory.

(Toner Replenishing Container)

The non-contact IC memory unit 400 comprises an IC 404 and an antenna coil 401 for causing electromagnetic induction. The non-contact IC memory unit 400 generates power for the IC 404 from electromagnetic waves transmitted from the communication control board 410 and transmits/receives communication data to/from the apparatus main body 100. For this reason, the toner replenishing containers 120Y, 120M, 120C and 120K can communicate without power supply from another source (e.g., a battery) and any electrical contacts for communication.

The IC 404 incorporates a modulation/demodulation circuit 402 which demodulates modulated data in data reception and modulates demodulated data to transmit it to an antenna in data transmission and the FeRAM 403 (to be referred to as RAM 403 hereinafter) which stores predetermined data.

(First Storage Section/Second Storage Section)

The RAM 403 is a rewritable memory and is mainly divided into two storage areas 403*a* and 403*b*. In FIG. 1, the first storage area 403*a* stores data which is written by a manufacturer or vendor and cannot be rewritten by the image forming apparatus main body 100. This data includes, e.g., the threshold value data of the service life or the replacement timing of each of the toner replenishing containers 120Y to 120K, a correction table for calculating the use amount and the toner replenishing amount, and the like.

The service life or the replacement timing threshold value data includes a threshold value representing the absence of toner, a threshold value for alarming the end of the service life or the arrival of the replacement timing of each toner replenishing container, a threshold value for notifying the end of service life or the arrival of the replacement timing, and the like. A correction table is used to calculate the toner discharge amount per unit rotational speed of the convey screw 12*a*, and examples of this table include a total amount used correction table based on the total amount of the toner used in the toner replenishing container, a temperature and humidity correction table based on a change in temperature and humidity of the apparatus main body, a driving amount correction table based on the rotational speed of the convey screw 12*a*, and the like. In addition, a toner correction table based on the type of toner, a component log correction table based on the components constituting a developing agent replenishing container, and the like may be employed.

The second storage area 403*b* is rewritten by the apparatus main body 100 and stores the data of the total amount of toner used, the data of error codes representing abnormal conditions, the use start date and use end date of the toner replenishing container, and the like.

(Image Forming Apparatus Main Body)

In FIG. 1, the apparatus main body 100 comprises the communication control board 410, an engine controller 420, a toner replenishment driving section 430, and a communication control board 440. Each of the communication control boards 410 and 440 comprises an antenna coil 411, a modulator/demodulator section 412, a communication control circuit section 413, and a resonance circuit section 414.

The communication control circuit section 413 is connected to a CPU 421 of the engine controller 420 and communicates with the engine controller 420. The toner replenishment driving section 430 comprises a rotational speed detecting section 431 which detects the rotational speed of a driving motor for supplying toner and a toner replenishment driving motor 432.

A temperature/humidity detecting section 500 is connected to a CPU 421 of the engine controller 420 and detects the ambient humidity in the main body 100.

(Process Cartridge)

Each of the process cartridges 90Y to 90K comprises a non-contact IC memory unit 450 having an arrangement similar to that of the IC 404 and the toner density sensor 10*g*.

Note that the memory unit 450 of the process cartridge comprises an IC 454 and an antenna coil 451 for causing electromagnetic induction, as well as the one of the toner storage container. The non-contact IC memory unit 450 generates power for the IC 454 from electromagnetic waves transmitted from the communication control board 440 and transmits/receives communication data to/from the apparatus main body 100. For this reason, each of the toner replenishing containers 120Y, 120M, 120C, and 120K can communicate without power supply from another source (e.g., a battery) provided on the side of the toner replenishing container and any electrical contacts.

The IC 454 incorporates a modulation/demodulation circuit 452 which demodulates modulated data in data reception and modulates demodulated data to transmit it to an antenna in data transmission and an FeRAM 453 which stores predetermined data.

(Remaining Toner Amount Detecting Mechanism)

A remaining toner detecting mechanism will be described next. In this embodiment, the amount of remaining toner is detected by utilizing the rotational speed of a toner replenishing means. Some parameters directly indicate the rotational speed, and the others indirectly indicate the rotational speed.

Parameters which directly indicate the rotational speed include, e.g., the rotation time, the number of rotations, and the rotation traveling distance of a driving shaft. To detect the rotational speed, there is available a method of arranging a rotation flag having a plurality of recesses on the driving shaft and detecting the timings and number of the ON/OFF of light passing through each recess of the rotation flag. Various known encoders may also be used. To detect the rotation traveling distance, for example, a laser Doppler speed detecting apparatus may be adopted.

Parameters which indirectly indicate the rotational speed include, e.g., a parameter which controls the driving motor of the toner replenishing means. If the driving motor comprises, e.g., a pulse motor, the rotational speed can be determined by the number of pulses to be input. Alternatively, if the driving motor comprises a DC servomotor, the rotational speed can be controlled by the input voltage and input time.

In this embodiment, an inexpensive DC motor is employed. Such the DC of this type motor changes the rotational speed depending on a generated load. In other words, even for a fixed period of time, the rotational speed varies greatly due to a variation in load. For this reason, the rotational speed cannot correctly be determined by control using the driving time. To avoid such variations, a uniform speed control circuit is preferably provided for a DC motor. However, use of this circuit increases the cost.

Therefore, in this embodiment, a rotation flag 32 is arranged in the rotation axis of the toner replenishment driving section, a flag sensor 33 counts the projections and recesses of slits, and the obtained count is used as the rotational speed, as shown in FIG. 23. Note that the rotation flag 32 may be arranged either on the side of the toner replenishing containers 120Y to 120K or on the side of the toner replenishment driving section of the apparatus main body 100.

As the convey screw 12*a* rotates, toner in the toner replenishing container is discharged, and the amount of remaining toner finally becomes substantially zero. In this embodiment, the integral rotational speed ratio between the rotation flag axis and the convey screw 12*a* is 3:1, and the slits are divided into eight parts consisting of projections and recesses. Hence, if each ON or OFF of the slits is counted, the convey screw 12*a* rotates once at the count of 24. At this time, the rotational speed is converted into the total amount of toner used using the correction table for calculating the amount used, and the obtained total amount used is compared with the service life or the replacement timing threshold value data, thereby detecting the amount of remaining toner.

(System Operation)

The operation of this system will be described below with reference to FIGS. 1 to 18.

(Toner Replenishing/Remaining Toner Amount Detecting Sequences)

Figure 2:
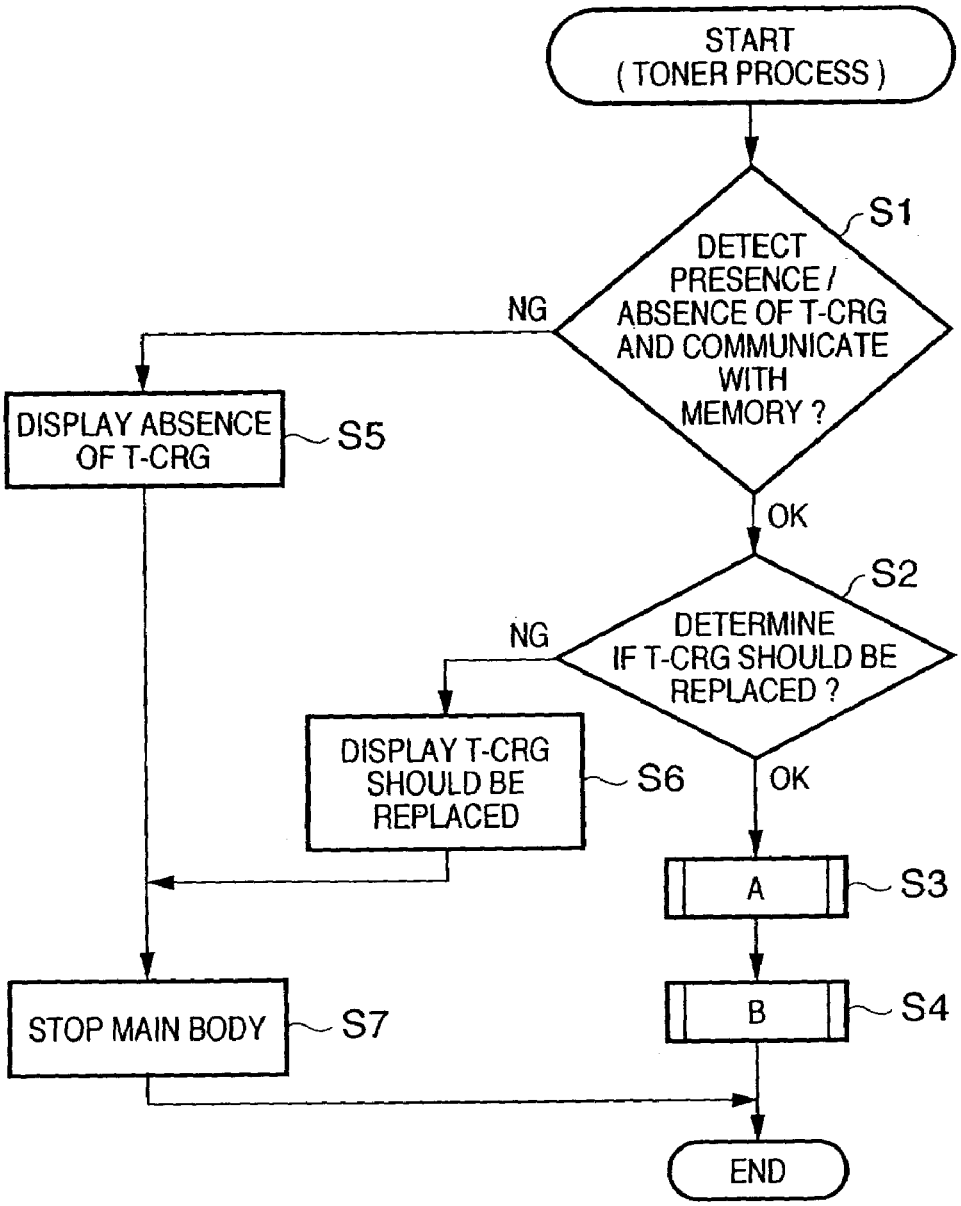
FIG. 2 is a flow chart showing the toner replenishing process according to the embodiment of the present invention.

The toner replenishing and remaining toner amount detecting sequences will be described with reference to FIGS. 2 to 18. FIG. 2 is a flow chart showing the initial sequence of the toner replenishing process according to the present invention.

First, in step S1, it is detected if each of the toner replenishing containers (to be referred to as "T-CRG" hereinafter as well as in the drawings) 120Y, 120M, 120C, and 120K is mounted in the apparatus main body 100. As shown in FIG. 1, each non-contact IC memory unit 400 responds to a predetermined resonance frequency transmitted from the communication control board 410, thereby detecting the presence/absence of the toner replenishing container.

If the non-contact IC memory unit 400 transmits predetermined ID data serving as identification information stored in the first storage area 403*a* of the RAM 403 by means of the modulator/demodulator section 402, it is determined that a corresponding one of the toner replenishing containers 120Y, 120M, 120C, and 120K exists, and the flow advances to step S2.

On the other hand, if no response comes back, it is determined that the corresponding one of the toner replenishing containers 120Y, 120M, 120C, and 120K is not mounted. Then, the flow advances to step S5, and the absence of the toner replenishing container is notified. The flow advances to step S7 to stop the apparatus main body 100. More specifically, the non-contact IC memory unit 400 attached to each of the toner replenishing containers 120Y, 120M, 120C, and 120K communicates with the communication control board 410 attached to the image forming apparatus, thereby checking the absence.

Next, in step S2, the end-of-service-life data or the arrival-of-replacement-timing data (data Le) of the non-contact IC memory unit 400 is checked. If the service life has not ended or it has not arrived at the replacement timing, it is determined that the toner-replenishing container is still available, and the flow advances to step S3 and then to step S4. On the other hand, if the service life has ended or it has arrived at the replacement timing, the end of service life or the arrival of the replacement timing is notified in step S6.

(Image Forming Process)

Figure 3:
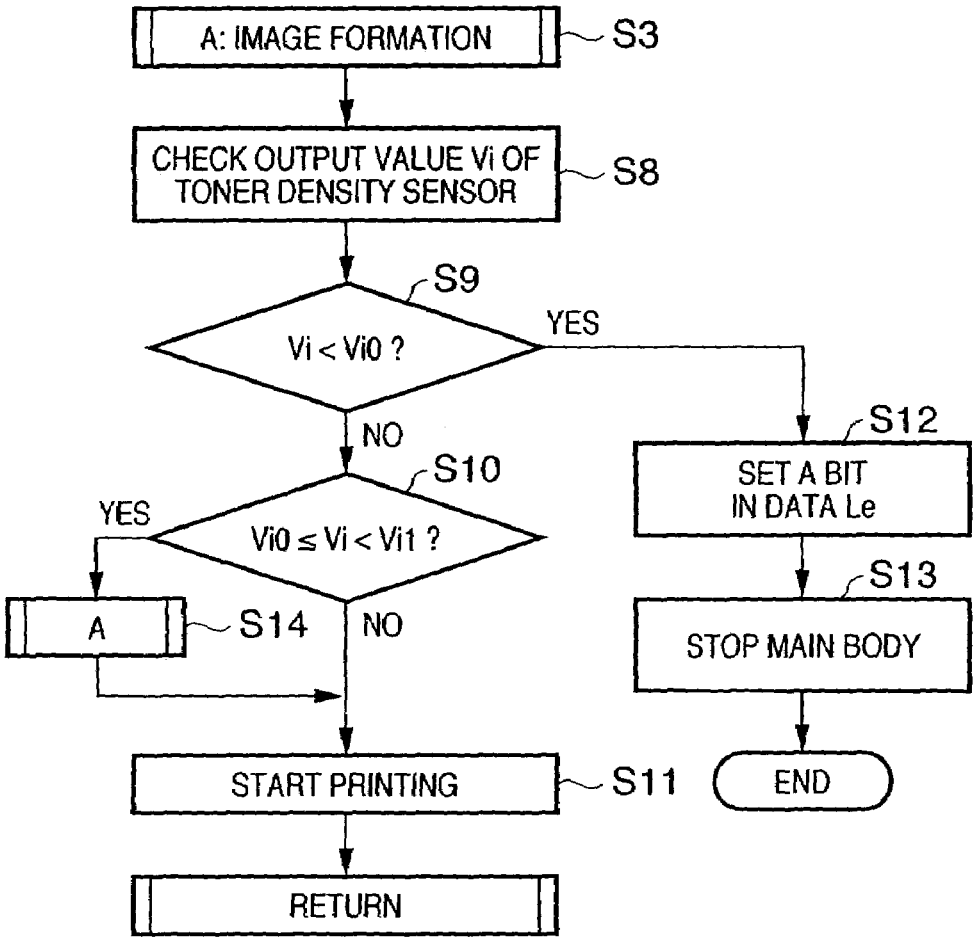
FIG. 3 is a flow chart showing image formation in the toner replenishing process according to the embodiment of the present invention.

FIG. 3 is a flow chart showing the process of the image forming section in toner replenishing operation.

First, an output signal Vi from the inductance sensor 10*g* attached to each of the process cartridges 90Y to 90K is sent to the CPU 421 of the apparatus main body 100, as shown in FIG. 1. The CPU 421 checks the output signal Vi, and the flow advances to step S8 to check a deviation from the reference value of the toner density. More specifically, the output signal Vi is compared with a predetermined value Vi0 in step S9. Reference symbol Vi0 denotes a threshold value which indicates the lower limit of the toner density. When image formation is continued without supplying toner, the toner density reaches this value. If this occurs, it can be determined that the service life of the toner replenishing container has ended or it has arrived at its replacement timing. Therefore, if Vi<Vi0 holds in step S9, the flow advances to step S12 to set a bit in the T-CRG end-of-service-life data or arrival-of-replacement-timing data Le, thereby stopping the main body in step S13.

This bit setting in the T-CRG end-of-service-life data or arrival-of-replacement-timing data Le in step S12 aims to leave in itself a log representing the end of the service life or the arrival of the replacement timing of the T-CRG. For example, even if the user mistakes this toner-replenishing container for a new one and mounts it in the apparatus main body, service life or replacement timing determination is performed in step S2, thereby avoiding any malfunctions.

If the log information is not left in each T-CRG, image forming operation may be performed again up to the comparison of Vi and Vi0 in step S9. In this case, when the toner density becomes a value much smaller than Vi0, the developing unit may be damaged.

On the other hand, if NO in step S9, the flow advances to step S10 to determine if the output signal Vi indicates the proper toner density. Reference symbol Vi1 denotes a threshold value indicating the proper value of the toner density. If Vi is equal to or more than Vi1, it is determined that the toner density is proper, and the flow advances to S11 to start printing. On the other hand, if the output value Vi<Vi1, it is determined that the toner density is low and that toner must be supplied, and the flow advances to step S14 to determine the flag rotational speed for toner replenishing operation.

(Toner Replenishing Operation/Flag Count Determination)

Figure 4:
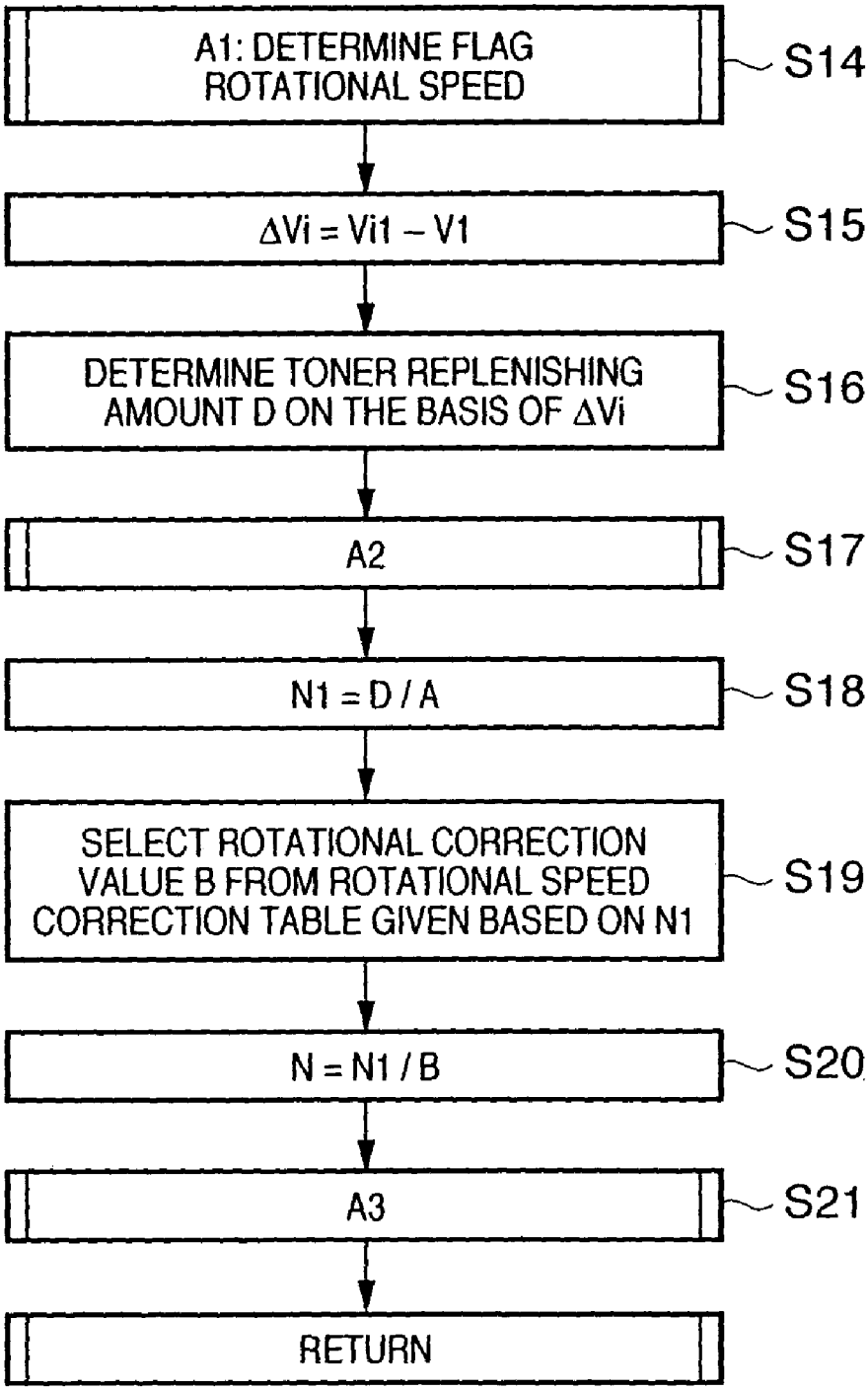
FIG. 4 is a flow chart showing determination of a flag rotational speed.
Figure 6:
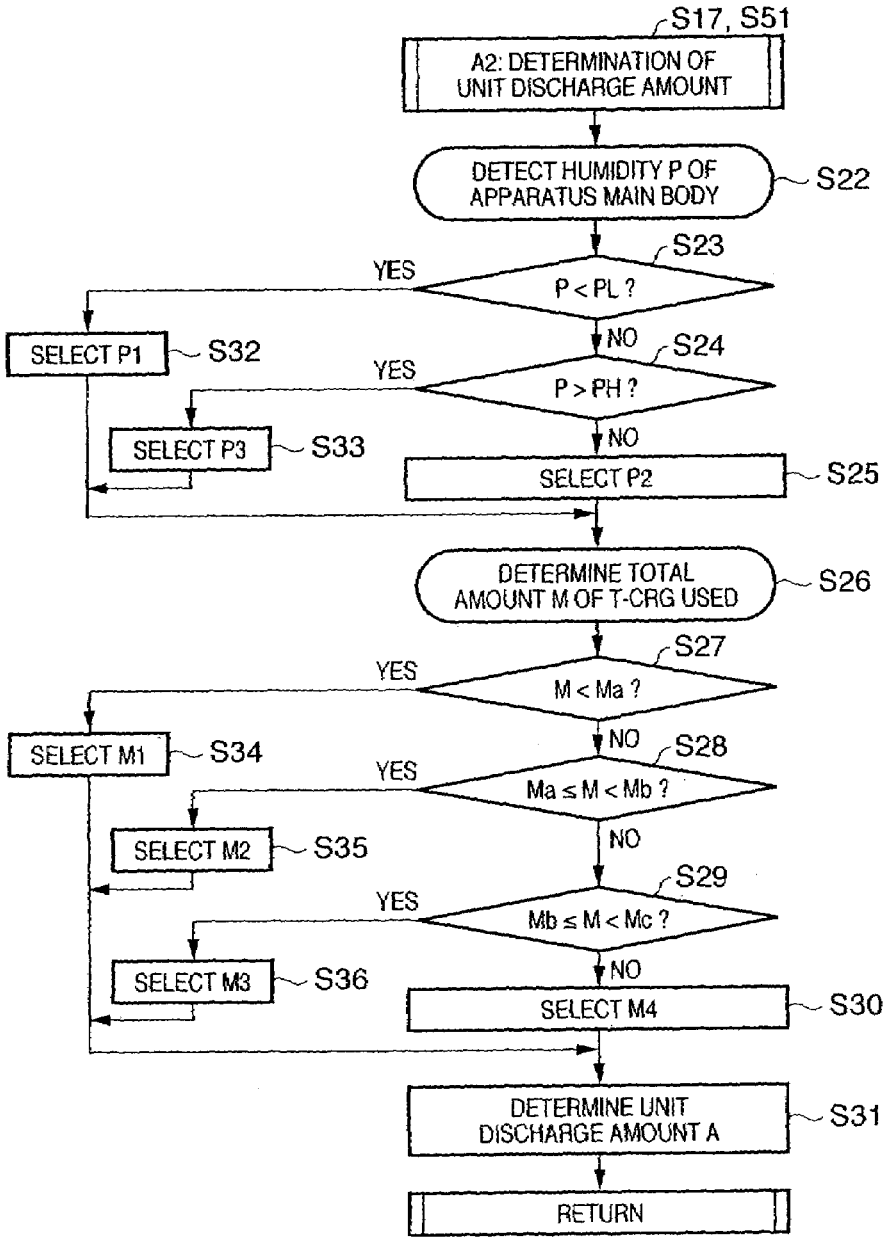
FIG. 6 is a flow chart showing the process of determining a unit discharge amount according to the embodiment of the present invention.

FIG. 4 is a flow chart showing the process of toner replenishing operation in toner replenishment processing.

In step S10, if it is determined that toner must be supplied, a difference ΔVi between the output value Vi and the reference value Vi1 is first calculated in step S15. At this time, ΔVi may be modified in accordance with the number of sheets to be printed and the printing rate. In step S16, a toner replenishing amount D is determined on the basis of ΔVi.

Then, a flag count N corresponding to the toner replenishing amount D is determined. In step S17, a unit discharge amount A per rotation flag count in the current situation is determined from the temperature and humidity correction table which is one of correction tables for calculating the toner replenishing amount stored in the first storage area 403*a* and the total amount used correction table based on the total amount of toner used.

In step S18, a flag count N1 is calculated from the toner replenishing amount D and unit discharge amount A (N1=D/A). In step S19, a rotational speed correction value B corresponding to the flag count N1 is selected, and in step S20, the flag count N1 is calculated.

The flow advances to the next step S21. A rotational speed correction table is one of the correction tables for calculating the toner replenishing amount stored in the first storage area 403*a*. The rotational speed correction table stores a constant representing a correction magnification for correcting the toner replenishing amount, which changes depending on a flag count per job (one toner replenishing operation), as shown in FIG. 5. In this embodiment, the rotational speed correction table is divided into five levels (Na to Ne). Flag rotational speeds from one for an image at the maximum printing ratio to one for an image at the minimum printing ratio are classified into five levels Na to Ne. An increase in number of levels leads to finer correction, while the rotational speed correction table occupies more space in the storage area. Therefore, the number of levels is preferably appropriately selected on the basis of the trade-off between the desired replenishment precision and the size of the whole storage area.

This control is required due to the following reason described with reference to FIG. 14. The magnification of the discharge amount with respect to the reference discharge amount is plotted along the ordinate of FIG. 14 and the flag count per job is plotted along the abscissa of FIG. 14.

Figure 14:
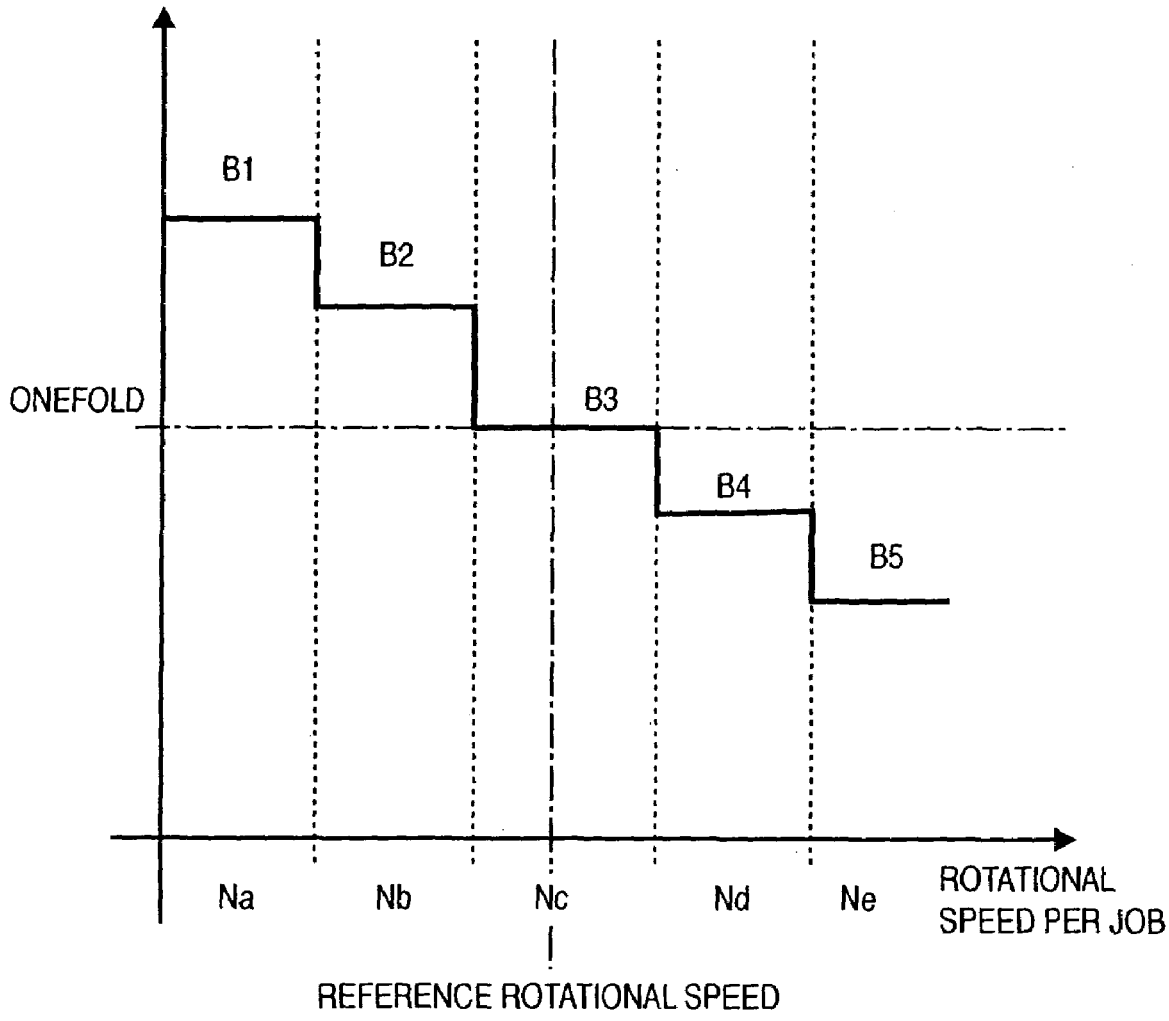
FIG. 14 is a graph showing a change in magnification of the unit discharge amount on the basis of variations in rotational speed according to the embodiment of the present invention.

In FIG. 14, a rotational speed Nc is defined as the reference rotational speed, and the toner discharge amount (unit discharge amount) per flag count at this rotational speed is set to 1. FIG. 14 plots a change in magnification of the unit discharge amount when the rotational speed is changed from Na to Ne. For example, assume that Ax is a unit discharge amount at Nc. Such correction is unnecessary if all possible flag counts within the total range satisfy the following condition:

$$Nc\times\alpha=Ax\times\alpha$$

In practice, correct toner replenishment cannot be performed, due to a loss in toner conveying efficiency of the convey screw 12*a* and the like, without modifying the above condition into:

$$Nc\times\alpha=Ax\times\alpha/Bx$$

Accordingly, correction is necessary. The correction table is stored in the first storage area 403*a* to allow correction for each individual T-CRG.

(Toner Replenishing Operation/Determination of Unit Discharge Amount)

Step S17 is a flow chart for selecting the unit discharge amount A in the current state from a unit discharge amount table.

The control over the selection of the unit discharge amount A per rotation flag count on the basis of the environmental conditions (temperature and humidity) of the apparatus main body and the total amount of toner used in the T-CRG (the amount of toner left in the T-CRG) will be described below.

The unit discharge amount A per rotation flag count is selected on the basis of the temperature and humidity in the apparatus main body and the total amount of toner used in the T-CRG for the following reason.

There is a close relationship between the fluidity of toner and the environment (temperature/humidity). For example, the fluidity decreases in an environment at high temperatures and high humidities while it increases in an environment at low temperatures and low humidities.

Also, there is a close relationship between the toner fluidity and the toner discharge (conveying) performance of the T-CRG.

For example, if the toner fluidity is too high, the unit discharge amount of the T-CRG may decrease. This is because (if the toner fluidity exceeds a certain level, the amount of air contained in a unit space increases and) the bulk density of toner conveyed by a screw decreases.

If the toner fluidity is too low, the unit discharge amount of the T-CRG may decrease. This is because (toner in a screw receiving section stagnates and) the amount of toner received into the screw toner receiving section decreases.

More specifically, the toner fluidity decreases in a high-temperature, high-humidity environment while it increases in a low-temperature, low-humidity environment. However, higher toner fluidity does not always increase the unit discharge amount. Excessively high toner fluidity can possibly decrease the unit discharge amount. Contrary to this, excessively low fluidity decreases the unit discharge amount.

As described above, the toner fluidity changes depending on the environment (temperature and humidity) of the apparatus, and the toner conveyability changes correspondingly.

The unit discharge amount also changes depending on the amount of toner left in the toner replenishing container. If the amount of toner left in the toner replenishing container is large (=the total discharge amount of toner is small), the unit discharge amount increases. On the other hand, if the amount of remaining toner is small, the unit discharge amount decreases.

Figure 17:
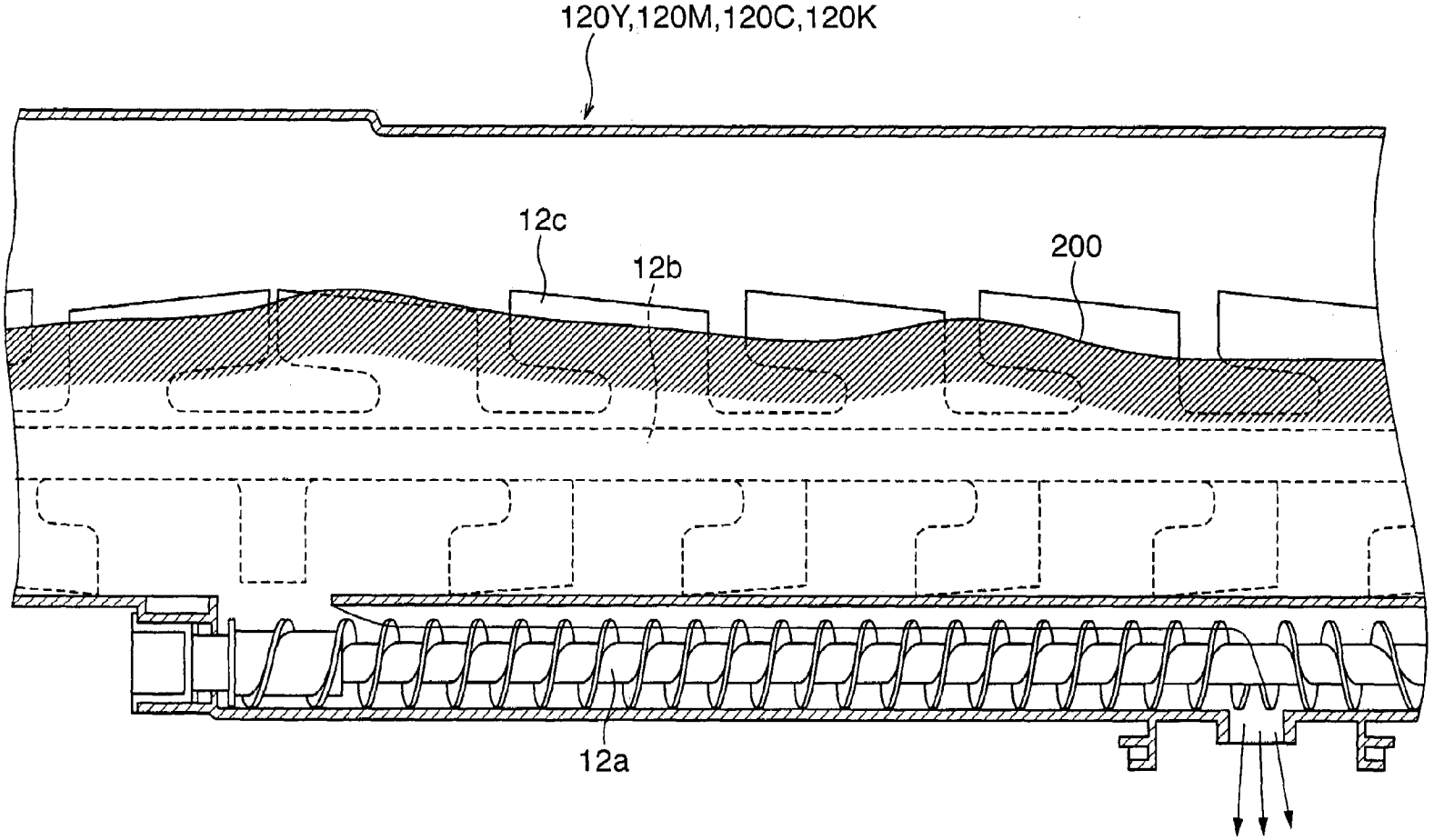
FIG. 17 is an explanatory view showing a change in remaining toner amount in the toner replenishing container according to the embodiment of the present invention.
Figure 18:
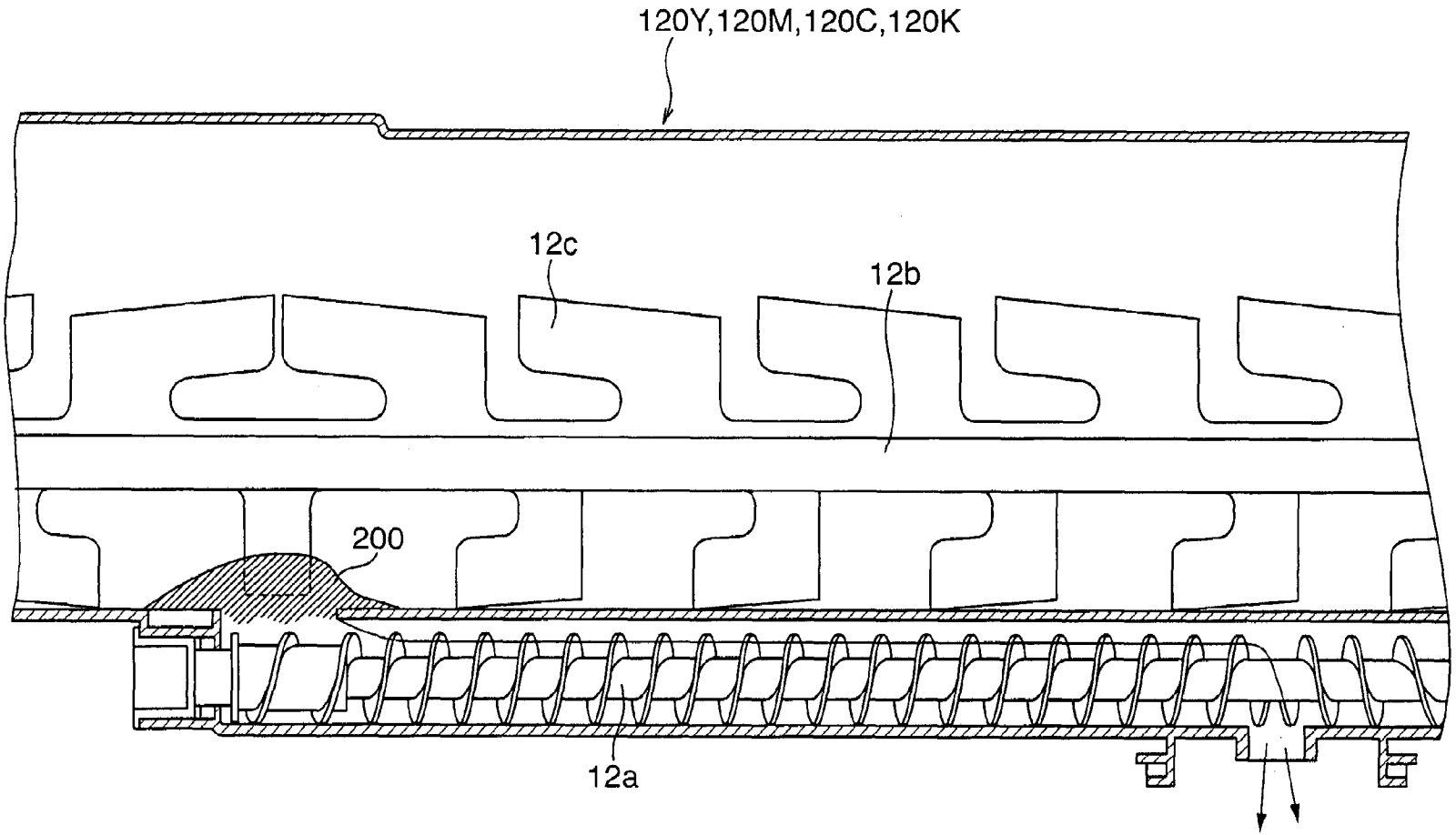
FIG. 18 is a view for explaining toner replenishing operation according to the embodiment of the present invention.

Note that FIGS. 17 and 18 show the amounts of remaining toner. FIG. 17 shows the state in which a large amount of toner 200 is left in each of the toner storage containers (120Y, 120M, 120C, and 120K). The stirring plate 12*c* fixed on the stirring shaft 12*b* and convey screw 12*a* are arranged in the toner storage container. The discharge opening portion 12*f* for discharging toner is formed at the bottom of the container. As shown in FIG. 17, if the amount of the remaining toner 200 is large, the unit discharge amount increases.

FIG. 18 shows the state in which the amount of the toner 200 left in the toner container is small. In this case, the unit discharge amount decreases. Note that the toner storage container has the same arrangement as that in FIG. 17.

In step S22, a temperature and humidity P of the apparatus main body at the current time is detected (note that the humidity represents the absolute water content ($g/m^3$) derived from the temperature/humidity in the apparatus main body). The humidity is compared with a threshold value (to be described later) and is determined using a value which is detected by a temperature/humidity detecting section 500 in FIG. 1 and is transmitted to the CPU.

It is determined in step S23 whether the detected temperature and humidity is less than a threshold value PL. If YES in step S23, P1 is selected (step S32). If NO in step S23, the detected temperature and humidity is compared with a threshold value PH. If the temperature and humidity is higher than PH, P3 is selected (step S33); otherwise, P2 is selected (step S25). P1 to P3 are factors for determining the unit discharge amount in the unit discharge amount table shown in FIG. 7. For example, when the threshold values PL and PH are set to a low temperature and humidity (about 8 $g/m^3$) and high temperature and humidity (about 15 $g/m^3$), respectively, P2 is selected, provided that the absolute water content is 10 $g/m^3$.

A total amount M of T-CRG used is detected in step S26. Factors M1 to M4 are selected to determine the unit discharge amount on the basis of the total use amount used M. It is determined in step S27 whether the total amount used M is smaller than a threshold Ma. If YES in step S27, M1 is selected (step S34). If the total amount used M is larger than Ma, it is determined in step S28 whether the total amount used M satisfies $Ma \leqq M < Mb$. If YES in step S28, M2 is selected in step S35. If NO in step S28, it is determined in step S29 whether the total amount used M satisfies $Mb \leqq M < Mc$. If YES in step S29, M3 is selected in step S36. If NO in step S29, M4 is selected in step S30. Ma, Mb, and Mc can be set as amounts corresponding to, e.g., 25%, 50%, and 75% of the total toner amount.

Since the factors for determining the unit discharge amount have been selected from the unit discharge amount table as described above, the unit discharge amount A is selected as one of A1-1 to A4-3 in accordance with combinations of P1 to P3 and M1 to M4 in step S31.

The unit discharge amount table is one of the correction tables for calculating the toner replenishing amount stored in the first storage area 403*a*. In this embodiment, the temperature and humidity is defined into three levels, and the total use amount in the T-CRG is defined into four levels. The numbers of levels of the table can naturally be optimized in accordance with the toner replenishment precision and the occupation ratio of the storage area.

This control is required due to the following reason described with reference to FIGS. 12 and 13. The total amount of toner used in T-CRG is plotted along the abscissa of FIG. 12, and the toner discharge amount (unit discharge amount) per rotation flag count is plotted along the ordinate of FIG. 12. A thick line in FIG. 12 represents an actual measurement value, while a thin line represents the average value of the unit discharge amounts in the intervals of the total discharge amounts M1 to M4.

Figure 12:
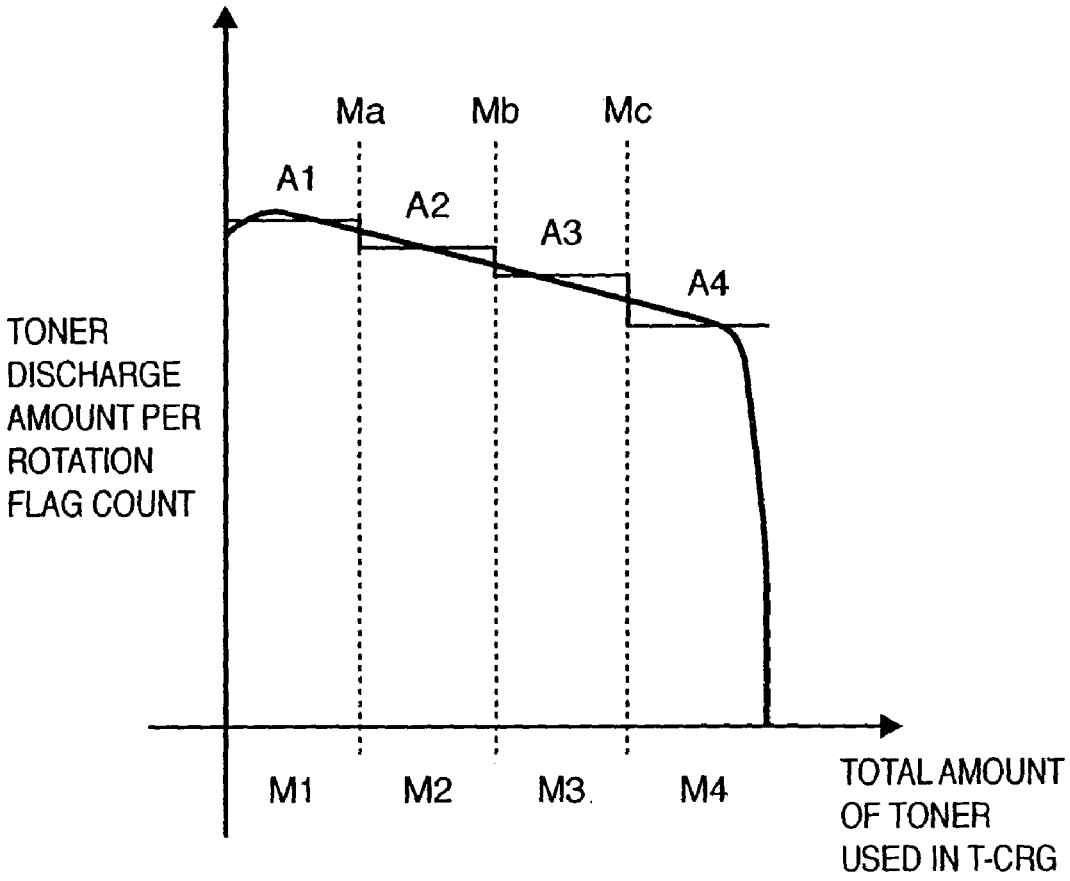
FIG. 12 is a graph showing the transition of a unit discharge amount with respect to that of the total amount of toner used according to the embodiment of the present invention.
Figure 13:
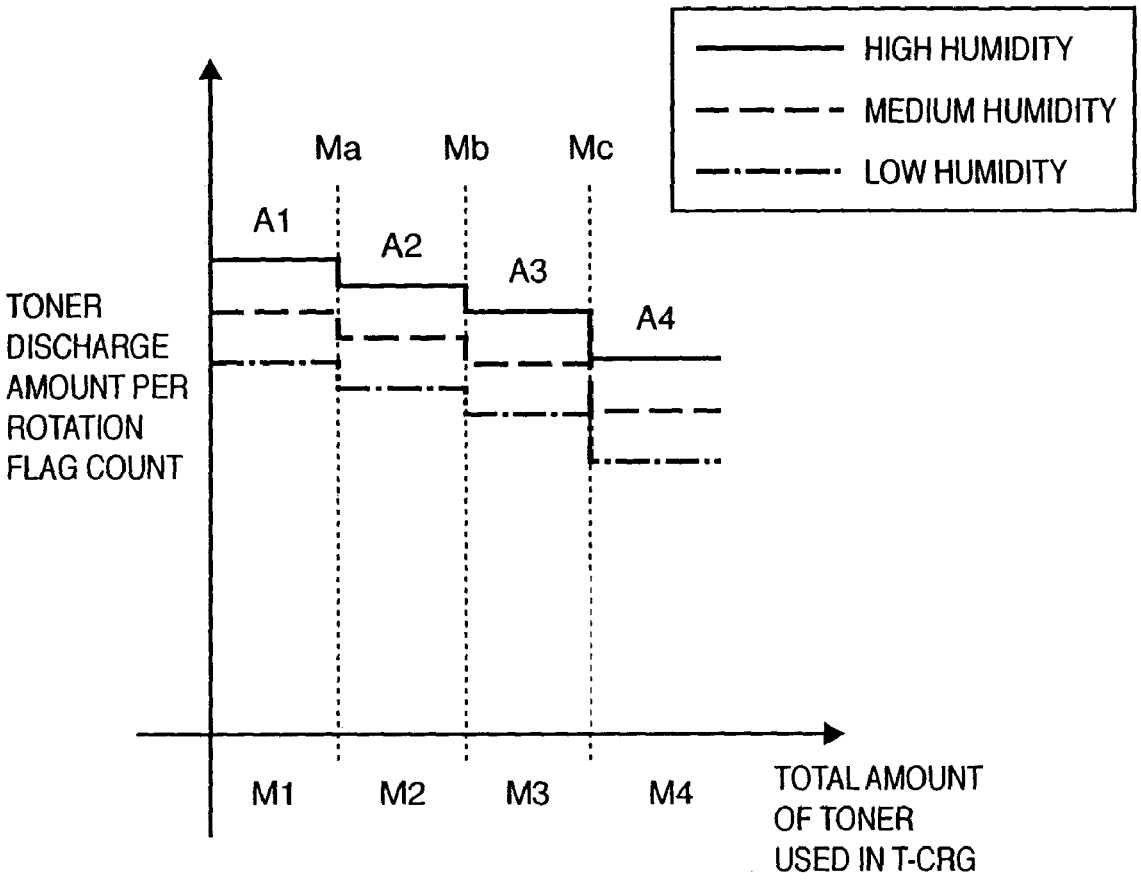
FIG. 13 is a graph showing an environmental difference in the transition of the unit discharge amount with respect to that of the total amount of toner used according to the embodiment of the present invention.

Referring to FIG. 12, the unit discharge amount decreases toward the right as the toner is consumed. As in FIG. 12, the total amount of toner used in the T-CRG is plotted along the abscissa of FIG. 13, and the toner discharge amount (unit discharge amount) per rotation flag count is plotted along the ordinate of FIG. 13. FIG. 13 shows the average values of the unit discharge amounts in the intervals of the total discharge amounts M1 to M4 in FIG. 12 at the high, medium, and low temperatures and humidities, as indicated by the solid, broken, and chain lines, respectively. As can be apparent from FIG. 13, the unit discharge amount is large at the high humidity and small at the low humidity.

If all these measurement values are lines parallel to the abscissa, the above control is not necessary. In practice, the unit discharge amount changes depending on the total amount of toner used in the T-CRG and the humidity.

The improvement of the toner replenishment precision can be expected by selecting an optimal current unit discharge amount from the table. In addition, this correction table is stored in the first storage area 403*a* to allow correction for each individual T-CRG.

In this embodiment, the correction values for determining the rotational speed and the amount of toner uses form a table stored in the first storage area 403*a*. Direct data such as the unit discharge amount in each toner replenishing container is used. As another method, appropriate data can be selected from a table stored in advance in the apparatus main body in accordance with, e.g., the type of toner and component log, thereby obtaining the same effect as described above.

The merit of the arrangement of this embodiment lies in that each toner replenishing container has a table itself to cope with all cases. More specifically, when the apparatus main body has a table, the main body must have all tables assumed upon all changes in the types of toners and component logs. The apparatus main body cannot cope with a case in which a correction value except the presumed ones is required. However, when the toner replenishing container has a table, all the correction values are stored in the toner replenishing container at the time of manufacture, thus posing no problem.

The influence of the toner fluidity on the environment of the apparatus has been described. The environment-dependent toner fluidity changes depending on the type of toner. For example, toners of different colors are different in fluidity. In some cases, toners of respective colors are different in toner fluidity in each environment. In these cases, a unit discharge amount table for each color toner only needs to be stored in a memory provided in the T-CRG of each color.

(Toner Replenishing Operation/Toner Replenishment)

Figure 8:
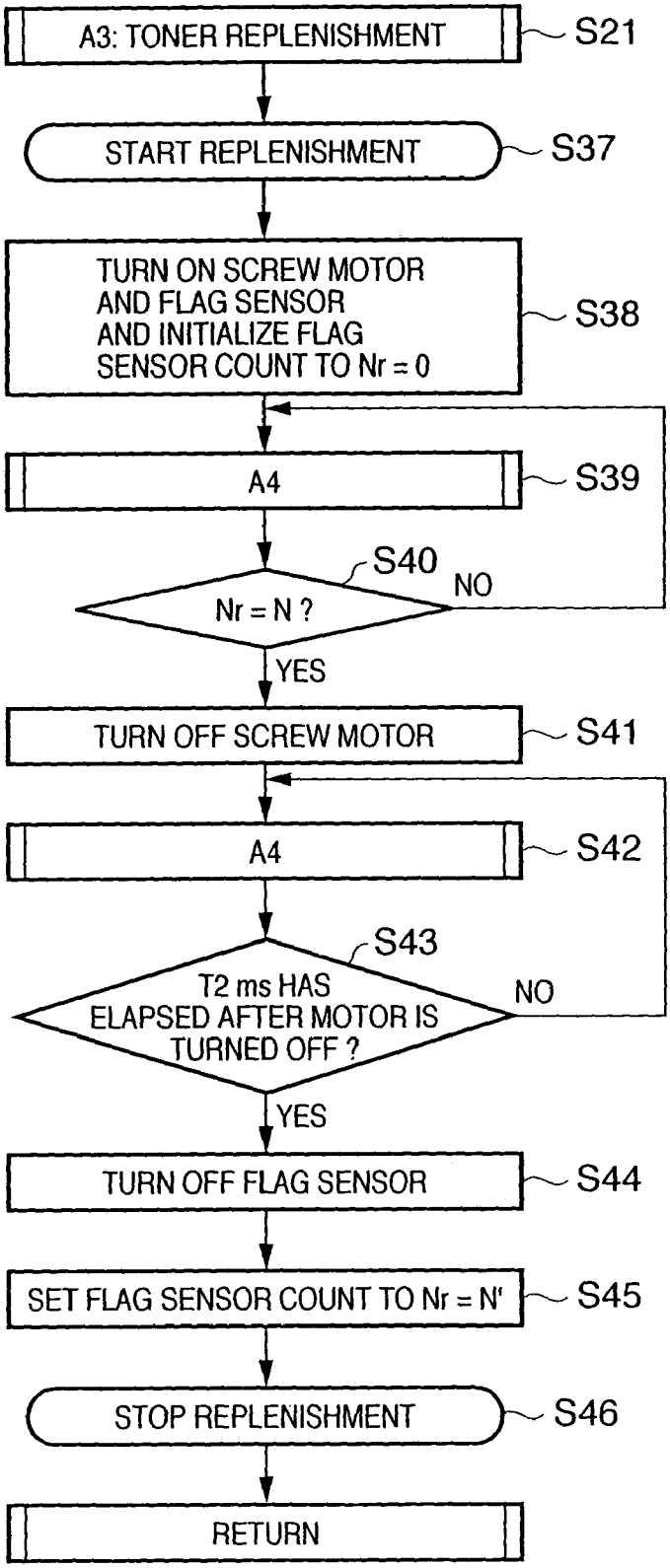
FIG. 8 is a flow chart showing the toner replenishing process according to the embodiment of the present invention.

FIG. 8 is a flow chart showing the process of toner replenishing operation in step S21 in FIG. 4. More specifically, after the flag count N is determined in step S20 of FIG. 4, replenishment starts from step S37.

Figure 15:
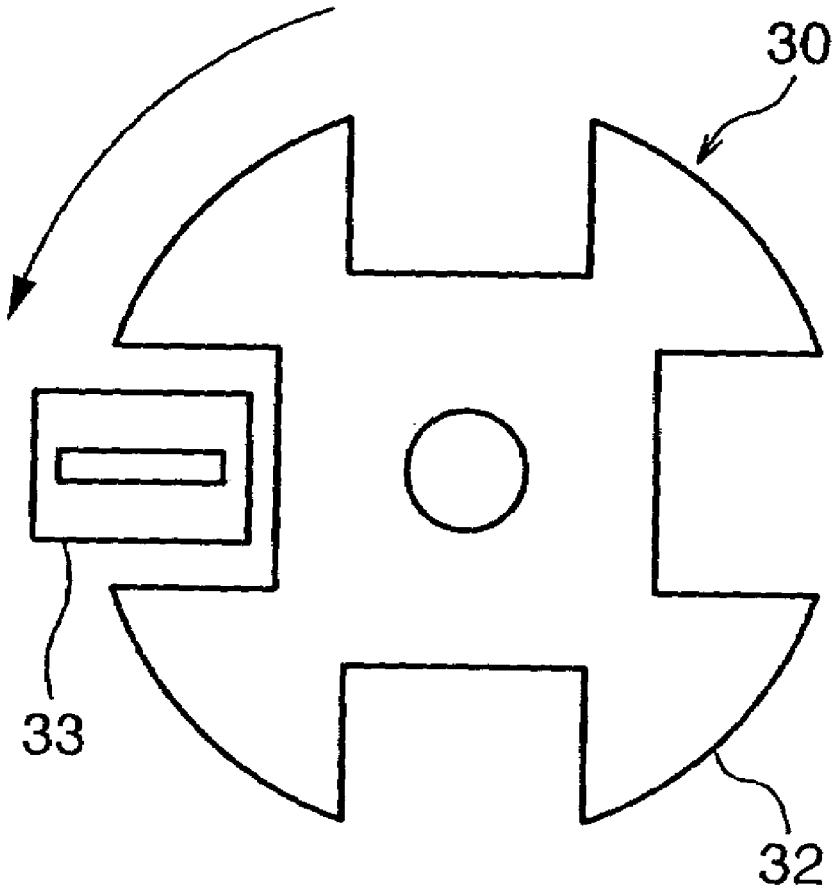
FIG. 15 is a side view showing the arrangement of a driving amount detecting section according to the embodiment of the present invention.

A count detecting mechanism in this embodiment will be described below. As shown in FIG. 15, the rotation flag 32 is attached to the driving shaft of a toner replenishment driving section 30. Slits form four projections and four recesses. The sensing surface of the flag sensor 33 is perpendicular to the rotational direction of the rotation flag 32.

The flag sensor 33 comprises a combination of a high-output infrared LED and a phototransistor. Light from the infrared LED repeatedly passes through or is shielded by the projections/recesses of the slits of the rotation flag 32 upon rotation of the rotation flag 32.

Figure 16:
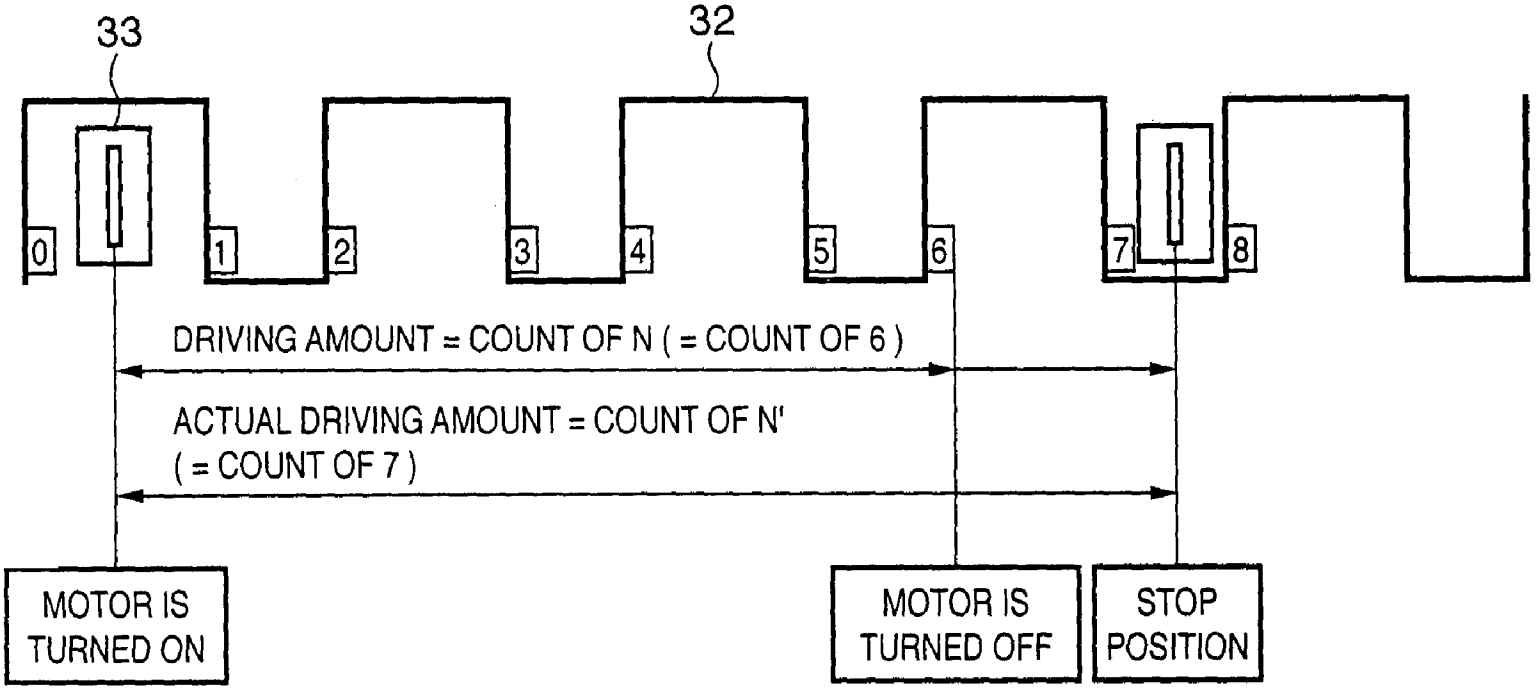
FIG. 16 is a view for explaining the process of counting the rotational speed according to the embodiment of the present invention.

As shown in FIG. 16, light from the infrared LED is shielded, an output signal from the phototransistor becomes HIGH. When the phototransistor receives light from the infrared LED, the phototransistor output becomes a LOW signal. The CPU 421 receives the output signal from the phototransistor to count the driving amount of the toner replenishment driving section 30.

Referring back to step S37, when replenishing operation starts, the toner replenishment driving section 30 (see FIGS. 19 and 23) drives the convey screw 12*a* in accordance with the rotational speed N determined previously.

In step S38, a driving motor 34 (see FIG. 23) of the screw 12*a* and the flag sensor 33 are turned on, and a count Nr of the flag sensor 33 is initialized (Nr=0). In step S39, the flag sensor 33 starts counting.

(Counting of Flag Sensor)

Figure 9:
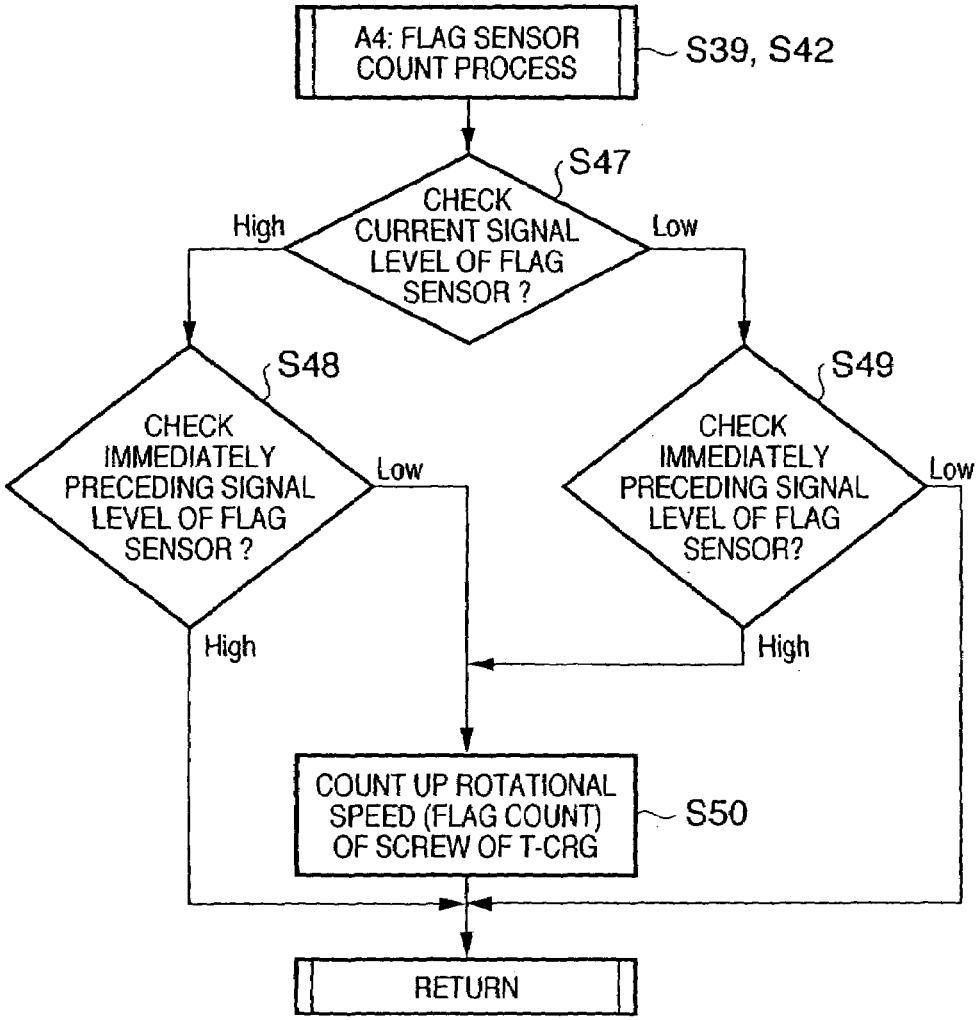
FIG. 9 is a flow chart showing the counting process of a flag sensor according to the embodiment of the present invention.

FIG. 9 is a flow chart showing the detailed counting process of the flag sensor 33 in step S39. In this case, the ON/OFF of light passing through each recess of the rotation flag 32 is counted, and this count is defined as a rotational speed.

In step S47, the current signal level of the flag sensor 33 is checked. In this embodiment, when either high level (HIGH) or low level (LOW) is detected as a signal level, the count is incremented by one. When high level is detected, the flow advances to step S48. When low level is detected, the flow advances to step S49.

The immediately preceding signal levels of the flag sensor 33 are checked in steps S48 and S49, respectively. If low level is detected in step S48 or high level is detected in step S49, the flow advances to step S50 to count up the driving amount Nr of the screw 12*a*. In this case, Nr=Nr+1.

If high level and low level are detected in steps S48 and S49, respectively, the flow returns to the flow in FIG. 8 to perform the process in step S40.

Referring back to FIG. 8, it is determined in step S40 whether the count Nr of the flag sensor 33 reaches the count N of the rotational speed. If YES in step S40, the flow advances to step S41 to turn off the driving motor 34. If NO in step S40, the counting process of the flag sensor in step S39 continues.

After the driving motor 34 is turned off in step S41, the flow advances to step S42 to perform the counting process of FIG. 9 again. It is determined in step S43 whether a predetermined period of time (T2 ms) has elapsed after the motor is turned off. If YES in step S43, the flow advances to step S45 to set the actual flag count to Nr=N'. The flow advances to step S44 to turn off the flag sensor 33. In step S46, replenishing operation stops.

The screw 12*a* starts/stops rotation upon turning on/off the driving motor 34. Strictly speaking, the screw 12*a* does not stop rotation as soon as the driving motor 34 is turned off. The toner replenishment driving section 30 has a given inertia, and this inertia shifts the stop timing. In particular, when the loads of the toner replenishing containers 120Y to 120K become light, that is, when the toner replenishing containers 120Y to 120K are almost at the end of service life, braking forces from the toner replenishing containers 120Y to 120K become small. This makes it difficult to immediately stop the screw 12*a*.

When the stop position varies, a difference occurs between the given rotational speed and the actual rotational speed. Accumulation of this difference makes it impossible to accurately predict the total discharge amount of toner. According to this embodiment, even after the driving motor 34 is turned off, the count of the rotation flag 32 is kept checked, and the actual rotational speed N' is kept detected.

(Write of Total Amount of Toner Used)

Figure 10:
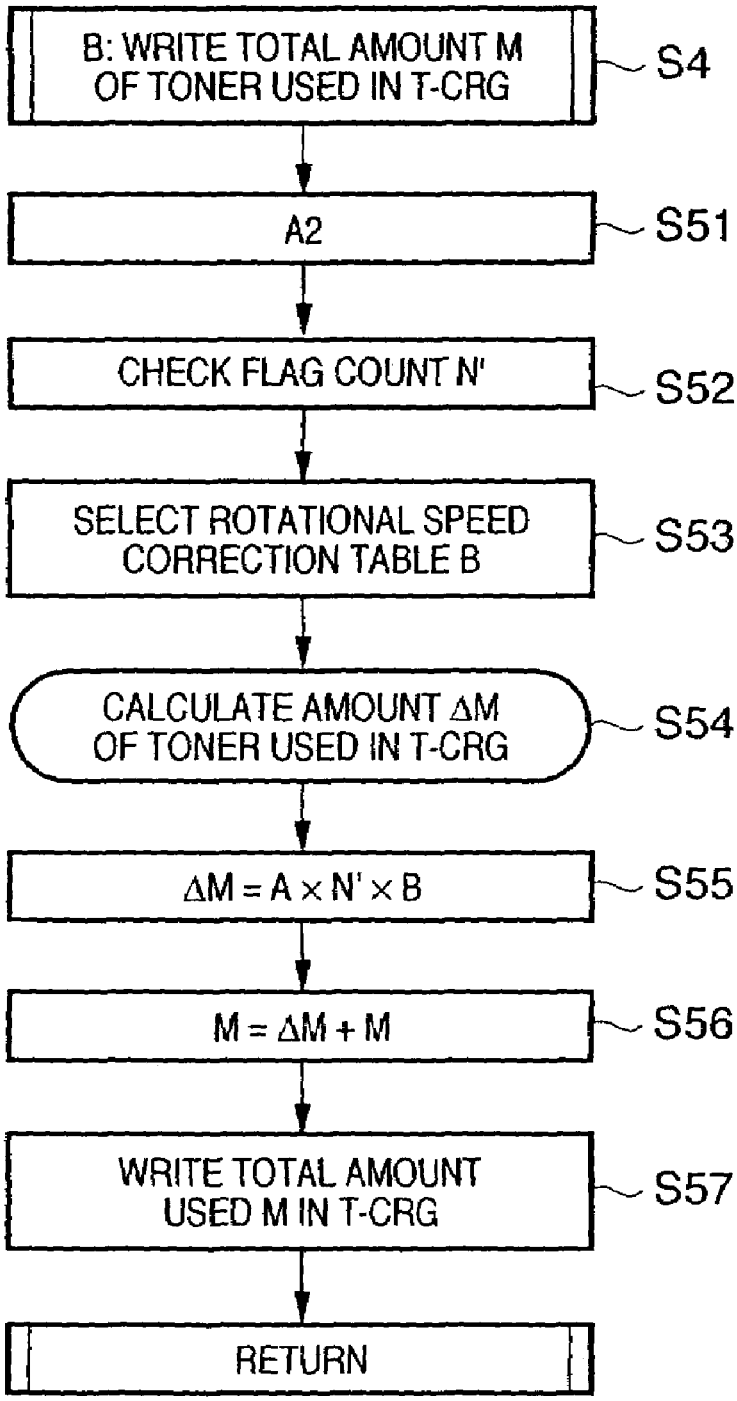
FIG. 10 is a flow chart showing the process of the total amount of toner used according to the embodiment of the present invention.

Referring back to FIG. 2, when the image forming process is complete upon toner replenishment in step S3, the flow advances to step S4 to leave a log representing the use period of the T-CRG. FIG. 10 shows a flow chart of the process (step S4) of writing the total amount M of toner used.

In step S51, the unit discharge amount A is selected from A1-1 to A4-3. In step S52, the flag count N' serving as the actual rotational speed is checked from step S45 in FIG. 8. In step S53, the rotational speed correction value B at the flag count N' is selected. The flow advances to step S54 to calculate the toner amount used ΔM per job. ΔM is calculated using the unit discharge amount A and the rotational speed correction value B of the flag count N' as:

$$\Delta M = A \times N' \times B \text{(step } S55\text{)}$$

The flow advances to step S56 to add ΔM to the total amount M of toner used of T-CRG used so far, thereby calculating the total amount M of toner used:

$$M = \Delta M + M$$

The flow advances to step S57 to store the total amount M of toner used, calculated in step S56, in the second storage area 403*b*. Such fine correction is performed because the unit discharge amount changes depending on the total amount of toner used. A log of the total amount of toner used must be left for each toner replenishing container.

(Detection of Remaining Toner)

The process of detecting the remaining toner in use of the toner replenishing system will be described with reference to the flow chart in FIG. 11.

The total amount M of toner used is checked in step S59. L1, L2, and L0 serving as a threshold value data for determining the toner service life or replacement timing stored in the first storage area 403*a* in step S60 are checked. L1 represents a threshold value for notifying the end of service life (the arrival of replacement timing); L2, a threshold value for alarming the end of service life (the arrival of replacement timing); and L0, a threshold value representing the absence of toner.

In step S61, the total amount M of toner used is compared with L1 serving as the first level for the service life threshold value. If M<L1, then it is determined that toner is left in a sufficient amount, and the flow advances to step S64. Otherwise, the flow advances to step S62.

In step S62, the total amount M is compared with L2 serving as the second level for the service life threshold value. If the total amount M satisfies condition L1≦M<L2, it is determined that the service life of the T-CRG is almost an end or it is close to the replacement timing, and the flow advances to step S67. In step S67, the end of service life or the arrival of replacement timing is notified on a display section 121 of the apparatus main body. The flow advances to step S64. The display section 121 preferably comprises an LED or liquid crystal panel.

If no condition in step S62 holds, it is determined that the T-CRG has already reached L2. In step S63, an alarm for the end of service life or the arrival of replacement timing is displayed, and the flow advances to step S64.

Figure 11:
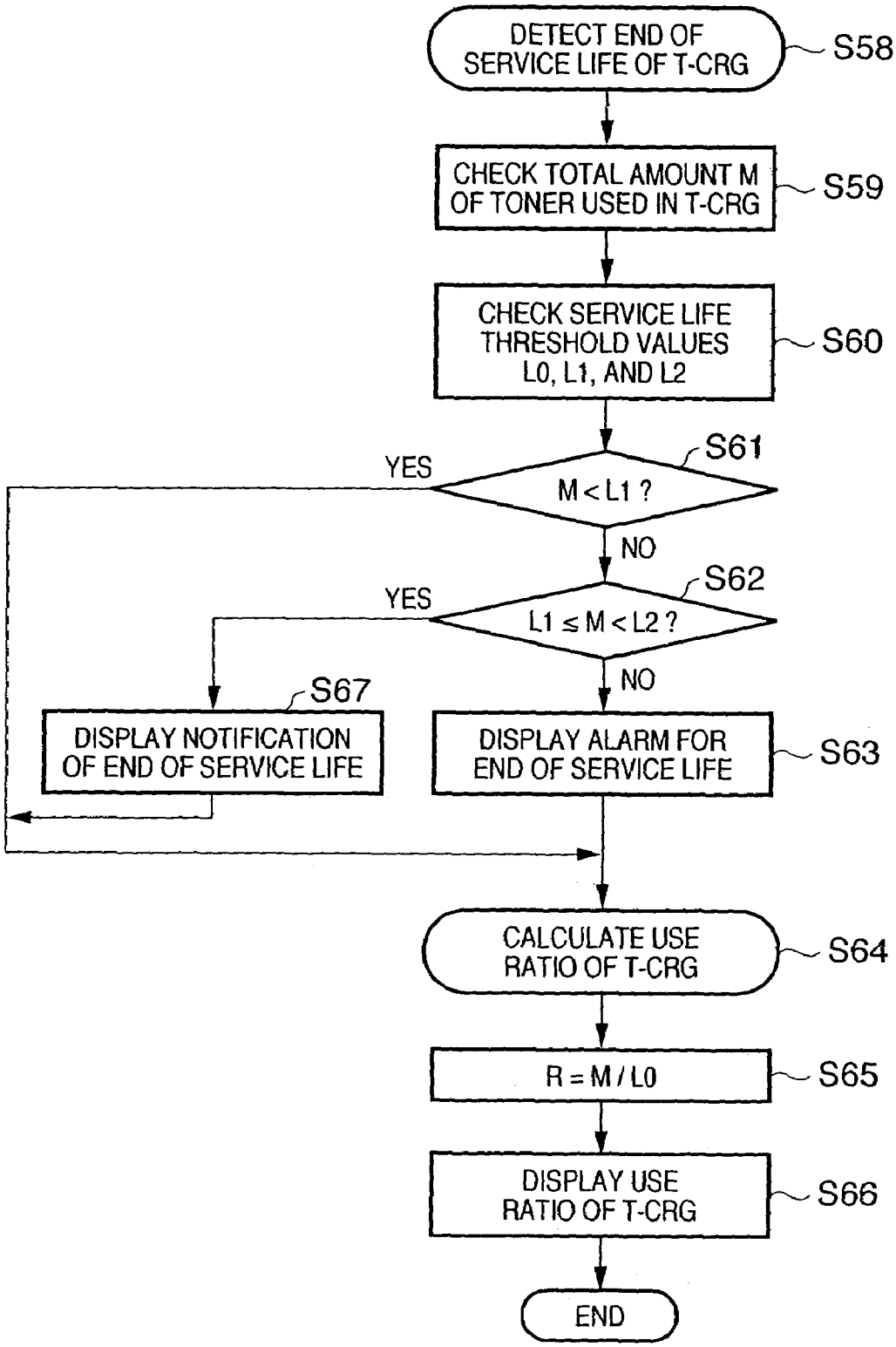
FIG. 11 is a flow chart showing the process of detecting the service life of a toner replenishing container according to the embodiment of the present invention.

Although not shown in FIG. 11, L0 may be compared with M. If M>L0, the end of service life or the arrival of replacement timing is determined. The flow advances to step S11 in FIG. 3 to set a bit in the T-CRG end-of-service-life data of arrival-of-replacement-timing data Le, thereby stopping the main body in step S12.

In step S64, the use ratio of T-CRG is calculated. In step S65, a ratio of L0 serving as the absence-of-toner level and M is calculated. In step S66, the ratio is displayed, so that the user can sequentially know the use ratio of this T-CRG and can use it for prediction of the replacement timing.

The amounts of toner left in the toner replenishing containers 120Y to 120K of this embodiment can accurately be predicted in accordance with the remaining toner amount detecting mechanism described above. When a toner replenishing container which reaches almost an end of service life or an arrival of replacement timing is used and a print job in a large amount is to be performed, the toner may run out during the job and the job may be interrupted.

In this case, the toner replenishing containers 120Y to 120K whose toner amounts are small are temporarily removed and replaced with new ones, and the job is executed. At the end of this job, the old toner replenishing containers 120Y to 120K are returned and can be used up.

The service lives or the replacement timings of the toner replenishing containers 120Y to 120K are stored in a memory respectively placed, and the service life (replacement timing) information will not be lost by replacement operation or the like. Any excessive setting work need not be performed in the apparatus main body 100. There can be provided a toner replenishing container and image forming apparatus which are more useful to users.

As described above, a color laser beam printer is exemplified as an electrophotographic image forming apparatus. However, the present invention is not limited to this. The present invention can be used for other electrophotographic image forming apparatuses such as an electrophotographic copying machine, LED printer, facsimile apparatus, or wordprocessor to obtain the same effect as described above.

The present invention is not limited to an electrophotographic image forming apparatus, but can be applied to apparatuses of other types such as an inkjet printer using ink as a printing agent.

As has been described above, according to the present invention, toner replenishment more accurate than a conventional one can be performed. The toner density in the developing unit can be stabilized, and higher-quality images can be provided. The replacement timing of the developing agent replenishing container can be accurately notified. When the developing agent replenishing container is empty, the electrophotographic image forming apparatus can be stopped. The failures of the cartridge and intermediate transfer belt can be prevented. The amount of toner left in the developing agent replenishing container can be made smaller. Stable toner replenishment can be achieved even almost at the end of service life. The amount of toner used can be more accurately predicted than the conventional case, and the user can be notified of the replacement timing of the developing agent replenishing container more accurately than the conventional case.

According to the present invention, more accurate toner replenishment than the conventional case is allowed. The toner density in the developing unit can be stabilized, and higher-quality images can be provided.

Since the total amount of toner used can be accurately detected, the replacement timing of the developing agent replenishing container can be accurately notified. When the developing agent replenishing container is empty, the electrophotographic image forming apparatus is stopped to prevent the failures of the cartridge and intermediate transfer belt.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the described embodiments and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above described embodiments are realized by executing the program codes which are read by a computer, the present invention includes a case where an OS (operating system) or the like working on the computer performs a part or entire processes in accordance with designations of the program codes and realizes functions according to the above described embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above described embodiments.

In a case where the present invention is applied to the aforesaid storage medium, the storage medium stores program codes corresponding to the flowcharts described in the embodiments.

The present invention is not limited to the above embodiments and various changes and modifications can be made within the spirit and scope of the present invention. Therefore to apprise the public of the scope of the present invention, the following claims are made.

It is thus believed that the operation and construction of the present invention will be apparent from the foregoing description. While the method, apparatus and system shown and described has been characterized as being preferred, it will be readily apparent that various changes and modifications could be made therein without departing from the scope of the invention as defined in the following claims.

What is claimed is:

1. An image forming apparatus comprising:

a first developing agent storing section which stores toner;

a toner replenishing member for supplying the toner stored in said first developing agent storing section to a second developing agent storing section;

a density detector for detecting a toner density in said second developing agent storing section;

a detecting section for detecting information relating to fluidity of the toner;

a use amount detector for detecting information relating to an amount of toner used in said first developing agent storing section;

a storage section for storing information relating to a toner replenishing amount in accordance with information relating to fluidity of the toner detected by said detecting section and information relating to the amount of toner used detected by said use amount detector; and a controller which controls an operation of said toner replenishing member on the basis of information relating to a detected toner density, and information relating to the toner replenishing amount.

2. The apparatus according to claim 1, wherein the information relating to the toner replenishing amount stored in said storage section is information relating to a toner replenishing amount per unit rotation of said toner replenishing member and wherein said controller calculates a number of times of operation of said toner replenishing member on the basis of the toner replenishing amount per unit rotation.

3. The apparatus according to claim 2, wherein said controller calculates a total amount of toner used in said first developing agent storing section on the basis of the number of times of operation of said toner replenishing member.

4. The apparatus according to claim 3, wherein said controller determines a state of an amount of the toner in said first developing agent storing section by comparing the total amount of toner used in said first developing agent storing section with a predetermined threshold value.

5. The apparatus according to claim 4, further comprising a notification unit configured to notify a user of the image of a determination result of said controller.

6. The apparatus according to claim 4, wherein an image forming operation of the apparatus is stopped when said controller determines that the total amount of the toner used in said first developing agent storing section reaches the predetermined threshold value.

7. The apparatus according to claim 1, further comprising wherein said detecting section includes an environment detecting section which detects an environment in a main body of the apparatus, and wherein information relating to the fluidity of the toner comprises information relating to a detected environment in the main body of the apparatus which is detected by the environment detecting section.

8. The apparatus according to claim 1, wherein said first developing agent storing section and toner replenishing member constitute a toner replenishing container which is integrally formed and detachable from a main body of the apparatus.

9. The apparatus according to claim 2, wherein said first developing agent storing section, said toner replenishing member, and said storage section constitute a toner replenishing container which is integrally formed and detachable from a main body of the apparatus.

10. A method of controlling an image forming apparatus comprising a first developing agent storing section which stores toner, a toner replenishing member for supplying the toner in the first developing agent storing section to a second developing agent storing section a density detector for detecting a toner density in the second developing agent storing section, and a storage section for storing information, the method comprising:

a use amount detecting step of detecting information relating to an amount of toner used in the first developing agent storing section;

a detection step for detecting information relating to fluidity of the toner;

a reading step for reading information relating to a toner replenishing amount in accordance with information relating to fluidity of the toner and information relating to the amount of toner used from said storage section; and an operation control step of controlling an operation of the toner replenishing member on the basis of information relating to a detected toner density and information relating to the toner replenishing amount.

11. The method according to claim 10, further comprising a detection step of detecting an environment in a main body of the apparatus, wherein information relating to the fluidity of the toner includes information relating to a detected environment in the main body of the apparatus which is detected in said detection step.

12. The method according to claim 10, further comprising a toner replenishing amount determination step of determining a toner replenishing amount per unit rotation of the toner replenishing member on the basis of the amount of a developing agent used determined in said use amount determination step and information relating to fluidity of the toner stored.

13. The method according to claim 12, further comprising a number of rotations calculation step of calculating a number of times of operation of the toner replenishing member on the basis of the toner replenishing amount per unit rotation determined in said toner replenishing amount determination step.

14. The method according to claim 13, further comprising a toner total use amount calculation step of calculating a total amount of toner used in the first developing agent storing section on the basis of the number of times of operation of the toner replenishing member calculated in said number of rotations calculation step.

15. The method according to claim 14, further comprising a determination step of determining a state of an amount of the toner in the first developing agent storing section from the total amount of toner used in the first developing storage section and a predetermined threshold value.

16. The method according to claim 15, further comprising a notification step of notifying a user of the apparatus of a determination result of said determination step.

17. The method according to claim 15, further comprising a stopping step of stopping an operation of the apparatus when it is determined in said determination step that the total amount of toner used in the first developing storage section reaches the predetermined threshold value.

18. A developing agent replenishing container which is detachable from an image forming apparatus, the container comprising:

a developing agent storing section which stores toner;

a toner replenishing member for supplying the toner to a main body of the apparatus; and a storage section which stores information relating to the toner, wherein said storage section includes a memory region which stores information relating to a toner replenishing amount in accordance with information relating to an amount of toner used in said developing agent storing section and information relating to fluidity of the toner.

19. The container according to claim 18, wherein the information relating to the toner replenishing amount includes information relating to a toner replenishing amount per unit rotation of said toner replenishing member in accordance with the information relating to the amount of the toner used in said developing agent storing section and information relating to fluidity of the toner.

20. The container according to claim 18, wherein said storage section includes a region which stores information relating to the amount of the toner used in said developing agent storing section.

21. A memory unit mounted in a developing agent replenishing container for use in an image forming apparatus, wherein the developing agent replenishing container comprises a toner replenishing member for supplying toner to a developing agent storing section of the image forming apparatus, and the image forming apparatus includes a detector for detecting information relating to fluidity of the toner, a use amount detector for detecting information relating to an amount of toner used in the developing agent replenishing container, and the memory unit comprises a memory region which stores information relating to toner replenishing amount in accordance with information relating to an amount of toner used in the first developing agent storing section and information relating to fluidity of the toner.

22. The memory unit according to claim 21, wherein, the use amount detector includes an environment detecting section which detects an environment in the apparatus, and wherein information relating to the fluidity of the toner includes information relating to the detected environment in the apparatus.

23. The memory unit according to claim 21, wherein the information relating to the toner replenishing amount includes information relating to a toner replenishing amount per unit rotation of the toner replenishing member in accordance with information relating to the amount of the toner used and information relating to the fluidity of the toner.

24. The memory unit according to claim 21, further comprising a region which stores information relating to the amount of the toner used in the first developing storage section.

25. The memory unit according to claim 21, further comprising a communication section for communicating with a main body of the apparatus.

26. An image forming apparatus which has a detachable cartridge comprising a first developing agent storing section which stores toner, a toner replenishing member for supplying the toner in the first developing agent storing section to an image forming section, a storage section which stores information relating to the toner, the apparatus comprising:

an image forming section; and a controller which controls an operation of the toner replenishing member on the basis of information relating to a toner replenishing amount according to information relating to an amount of toner used in the first developing agent storing section detected by a use amount detector and information relating to an environment in a main body of the apparatus detected by an environment detector, stored in the storage section.

27. The apparatus according to claim 26, wherein information relating to the toner replenishing amount includes information relating to a toner replenishing amount per unit rotation of the toner replenishing member in accordance with information relating to the amount of toner used in the first developing agent storing section and information relating to the environment in the main body of the apparatus, and wherein said controller calculates a number of times of operation of the toner replenishing member on the basis of the toner replenishing amount per unit rotation.

28. The apparatus according to claim 27, wherein said controller also calculates a total amount of toner used in the first developing agent storing section on the basis of the number of times of operation of the toner replenishing member.

29. The apparatus according to claim 28, wherein said controller determines a state of an amount of the toner in the first developing agent storing section by comparing the total amount of toner used in the first developing agent storing section with a predetermined threshold value.

30. A developing agent replenishing container which is detachable from an image forming apparatus, the container comprising:

a developing agent storing section which stores toner;

a toner replenishing member for supplying the toner to a main body of the apparatus; and a storage section which stores information relating to the toner, wherein said storage section includes a memory region which stores information relating to toner replenishing amount according to information relating to an amount of toner used in said first developing agent storing section and information relating to an environment in a main body of the apparatus.

31. The container according to claim 30, wherein information relating to the toner replenishing amount toner includes information relating to a toner replenishing amount per unit rotation of said toner replenishing member in accordance with information relating to the amount of toner used and information relating to the fluidity of the toner.

32. The container according to claim 30, wherein said storage section includes a region which stores information relating to the amount of the toner used in said developing agent storing section.

33. A memory unit mounted in a developing agent replenishing container for use in an image forming apparatus, wherein said developing agent replenishment container comprises a toner replenishing member for replenishing toner to an image forming section of the apparatus, the memory unit comprises a memory region which stores information relating to a toner replenishing amount according to information relating to an amount of toner used in said developing replenishing container and information relating to an environment in a main body of the apparatus.

34. The memory unit according to claim 30, wherein information relating to toner replenishing amount includes information relating to a toner replenishing amount per unit rotation of the toner replenishing member in accordance with information relating to the amount of toner used in the first developing agent storing section and information relating to fluidity of the toner.

35. The memory unit according to claim 33, further comprising a region which stores information relating to the amount of the toner used in the developing agent replenishing container.

36. The memory unit according to claim 33, further comprising a communication section for communicating with a main body of the apparatus.

* * * * *

UNITED STATES PATENT AND TRADEMARK OFFICE

CERTIFICATE OF CORRECTION

PATENT NO. : 7,003,233 B2
APPLICATION NO. : 10/648605
DATED : February 21, 2006
INVENTOR(S) : Kenji Matsuda et al.

It is certified that error appears in the above-identified patent and that said Letters Patent is hereby corrected as shown below:

ON THE TITLE PAGE:

UNDER REFERENCES CITED, ITEM (56):

"2002268295 A" should read --2002-268295 A--;
"07248677 A" should read --07-248677 A--; and
"2003076131 A" should read --2003-076131 A--.

COLUMN 20:

Line 53, "uses" should read --used--.

COLUMN 23:

Line 67, "wordprocessor" should read --word processor--.

COLUMN 25:

Line 46, "member" should read --member,--.

COLUMN 26:

Line 23, "section" should read --section,--.

COLUMN 28:

Line 23, "wherein" should read --wherein,--.

Signed and Sealed this

Fifteenth Day of August, 2006

JON W. DUDAS
*Director of the United States Patent and Trademark Office*